US012188132B2

(12) United States Patent
Ukigai et al.

(10) Patent No.: US 12,188,132 B2
(45) **Date of Patent: *Jan. 7, 2025**

(54) SANITARY EQUIPMENT PART AND METHOD OF PRODUCING THE SAME

(71) Applicant: TOTO LTD., Fukuoka (JP)

(72) Inventors: Saori Ukigai, Fukuoka (JP); Ryojiro Hijikata, Fukuoka (JP); Ryo Koga, Fukuoka (JP)

(73) Assignee: TOTO LTD., Fukuoka (JP)

( * ) Notice: Subject to any disclaimer, the term of this patent is extended or adjusted under 35 U.S.C. 154(b) by 836 days.

This patent is subject to a terminal disclaimer.

(21) Appl. No.: 17/212,537

(22) Filed: Mar. 25, 2021

(65) Prior Publication Data

US 2021/0277522 A1 Sep. 9, 2021

Related U.S. Application Data

(63) Continuation of application No. PCT/JP2019/038370, filed on Sep. 27, 2019.

(30) Foreign Application Priority Data

Sep. 27, 2018 (JP) ..... 2018-181761
Sep. 27, 2018 (JP) ..... 2018-181762
Mar. 29, 2019 (JP) ..... 2019-066026

(51) Int. Cl.
*C23C 22/78* (2006.01)
*C23C 22/03* (2006.01)
(Continued)

(52) U.S. Cl.
CPC ..... *C23C 22/78* (2013.01); *C23C 22/03* (2013.01); *C23C 22/73* (2013.01); *C23C 22/83* (2013.01);
(Continued)

(58) Field of Classification Search
CPC ..... C23C 2222/10; C23C 22/03; C23C 22/73; C23C 22/78; C23C 22/82; C23C 22/83;
(Continued)

(56) References Cited

U.S. PATENT DOCUMENTS

2002/0011280 A1 1/2002 Nitowski et al.
2003/0186914 A1 10/2003 Hofer et al.
(Continued)

FOREIGN PATENT DOCUMENTS

CN 104710109 B 9/2017
JP 2000-265526 A 9/2000
(Continued)

OTHER PUBLICATIONS

Maxisch et al., "PM-IRRAS studies of the adsorption and stability of organophosphonate monolayers on passivated NiTi surfaces," Applied Surface Science 257:2011-2018 (2011).
(Continued)

*Primary Examiner* — Lois L Zheng
(74) *Attorney, Agent, or Firm* — MARSHALL, GERSTEIN & BORUN LLP

(57) ABSTRACT

To provide a sanitary facility member having excellent ease of contamination removal and excellent persistence of ease of contamination removal. A sanitary facility member including: a base material, at least the surface of which includes a metal element; a metal oxide layer formed on the surface of the base material; and an organic layer provided on the metal oxide layer; wherein the metal element is at least one element selected from the group consisting of Cr, Zr, and Ti, the metal oxide layer includes at least the metal element and an oxygen element, and the organic layer is bonded to the metal oxide layer by bonding (M-O—P bonding) of the metal element (M) and a phosphorus atom (P) of at least one group (X) selected from a phosphonic acid
(Continued)

group, a phosphoric acid group, and a phosphinic acid group via an oxygen atom (O), the group X being bonded to a group R (where R is a hydrocarbon or a group having an atom other than carbon in 1 or 2 locations in a hydrocarbon group).

17 Claims, 8 Drawing Sheets

(51) Int. Cl.

| | |
|---|---|
| ***C23C 22/73*** | (2006.01) |
| ***C23C 22/83*** | (2006.01) |
| ***C23C 28/00*** | (2006.01) |
| ***C25D 3/04*** | (2006.01) |
| ***C25D 3/12*** | (2006.01) |
| ***E03C 1/04*** | (2006.01) |

(52) U.S. Cl.
CPC ..... *C23C 28/00* (2013.01); *C25D 3/04* (2013.01); *C25D 3/12* (2013.01); *E03C 1/0412* (2013.01)

(58) Field of Classification Search
CPC ..... C23C 28/00; C23C 28/32; C23C 28/34; C23C 28/345; C23C 28/30; C23G 1/00; C23G 1/14
See application file for complete search history.

(56) References Cited

U.S. PATENT DOCUMENTS

| | | | | |
|---|---|---|---|---|
| 2010/0227177 | A1 | 9/2010 | Shigeru et al. | |
| 2011/0272284 | A1 | 11/2011 | Elbick et al. | |
| 2018/0103642 | A1* | 4/2018 | Clevenger ..... | C25D 11/26 |
| 2018/0244978 | A1 | 8/2018 | Drees et al. | |

FOREIGN PATENT DOCUMENTS

| | | | |
|---|---|---|---|
| JP | 2002-518594 | A | 6/2002 |
| JP | 2004-217950 | A | 8/2004 |
| JP | 2013-185216 | A | 9/2013 |
| JP | 2015-214072 | A | 12/2015 |

OTHER PUBLICATIONS

Search Report from European Application No. 19867676.9 dated Apr. 13, 2022.
Harm et al., "Neuartiges Primersystem Fuer Eisen und Stahl Mit Self-Assembled Monolayers (Sam) und Leitfaehigen Pol Ymeren", Galvanotechnik, Leuze Verlag, 97(3):676-681 (2006).
Extended European Search Report from European Application No. 19867676.9 dated Jul. 4, 2022.
International Search Report from International Application No. PCT/JP2019/038370 dated Nov. 5, 2019.
Office Action from Chinese Application No. 201980003252.0 dated Aug. 31, 2022.
Harm et al., "Novel primer system for iron and steel with Self-assembled monolayers (SAM) and conductive polymers," Electroplating, 97(3):676-681 (2006) (English Machine Translation).

* cited by examiner

SANITARY EQUIPMENT PART AND METHOD OF PRODUCING THE SAME

CROSS-REFERENCE TO RELATED APPLICATIONS

This is a Continuation of International Application No. PCT/JP2019/038370, filed Sep. 27, 2019, which claims priority to Japanese Application No. 2018-181761, filed Sep. 27, 2018, Japanese Application No. 2018-181762, filed Sep. 27, 2018 and Japanese Application No. 2019-066026, filed Mar. 29, 2019, the contents of which are incorporated herein by reference.

TECHNICAL FIELD

The present invention relates to a sanitary equipment part including a base material having a metal element at least on a surface thereof, and preferably to a sanitary equipment part used indoors or in an environment exposed to water.

BACKGROUND ART

Metal parts indoors are used for parts that are frequently touched by hands, such as handles and levers. For this reason, sebum stains such as fingerprints adhere, impairing the appearance. Although these stains are wiped and cleaned, they need to be scrubbed many times for removal because, for example, they are highly viscous and stretched by wiping, which is a heavy burden for cleaning. Therefore, it is required that sebum stains can be removed by simple cleaning.

In addition, the parts used in wet areas (also referred to as wet area parts) are used in an environment where water is present. Therefore, water tends to adhere to the surface of a wet area part. It is known that when the water adhering to the surface dries, scales containing silica and calcium, which are components contained in tap water, are formed on the surface of the wet area part. It is also known that stains such as proteins, sebum, molds, microorganisms, and soap adhere to the surface of the wet area part.

Since it is difficult to prevent these stains from adhering to the surface of the wet area part, it is customary to remove the stains on the surface by cleaning to restore the original state. Specifically, these stains are removed by rubbing the surface of the wet area part with a cloth or sponge using detergent or tap water. Therefore, wet area parts are required to have easiness to remove stains, that is, removal performance.

In addition, the wet area part is also required to have a high degree of design. In particular, a metal part having a metal element on a surface thereof is preferably used on the surface of the wet area part for its beautiful appearance. Therefore, it is required to impart removal performance without damaging the design of the metal part.

In this regard, a technique for removing scales using a water-repellent antifouling layer is known. Japanese Patent Application Publication No. 2000-265526 states that the fixation of silicic acid scale stains is suppressed by providing an antifouling layer that shields hydroxyl groups on the surface of pottery. It is disclosed that this antifouling layer is an antifouling layer coated and dried with a mixture of the hydroxyl groups on the surface of pottery, an organic silicon compound containing an alkyl fluoride group, a methylpolysiloxane compound containing a hydrolyzable group, and an organopolysiloxane compound.

In addition, Japanese Patent Application Publication No. 2004-217950 states that scale removal performance is obtained by treating the plated surface of a faucet or the like with a surface treatment agent for a plating film containing a fluorine atom-containing compound containing a fluorine-containing group and a group having a complex-forming ability.

CITATION LIST

Patent Literatures

Patent Literature 1: Japanese Patent Application Publication No. 2000-265526

Patent Literature 2: Japanese Patent Application Publication No. 2004-217950

SUMMARY OF INVENTION

Problems to be Solved by the Invention

Neither the antifouling layer described in Japanese Patent Application Publication No. 2000-265526 nor the surface treatment described in Japanese Patent Application Publication No. 2004-217950 has obtained sufficient performance in terms of scale removal performance and its durability. In view of the above, an object of the present invention is to provide a sanitary equipment part excellent in scale removal performance and its durability.

Means for Solution of the Problems

The present inventors have found that it is possible to obtain scale removal performance and its durability by using a layer of organic compound formed by use of a compound represented by the general formula R—X (R is a hydrocarbon group or a group having an atom other than carbon at one or two positions in the hydrocarbon group, and X is at least one selected from a phosphonic acid group, a phosphoric acid group, and a phosphinic acid group) as a layer of organic compound provided on a base material having a metal element at least on a surface thereof, and forming the layer of organic compound via a layer of metal oxide formed on the base material. Thus, the present inventors have completed the present invention based on these findings. Specifically, the present invention provides a sanitary equipment part, the sanitary equipment part including:

- a base material having a metal element at least on a surface thereof;
- a layer of metal oxide formed on the surface of the base material; and
- a layer of organic compound provided on the layer of metal oxide, wherein
- the metal element is at least one selected from the group consisting of Cr, Zr, and Ti,
- the layer of metal oxide contains at least the metal element and an oxygen element, and
- the layer of organic compound binds to the layer of metal oxide by binding the metal element (M) via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group.

Advantageous Effects of Invention

The present invention makes it possible to provide a sanitary equipment part excellent in scale removal performance and its durability.

DESCRIPTION OF EMBODIMENTS

Figure 1:
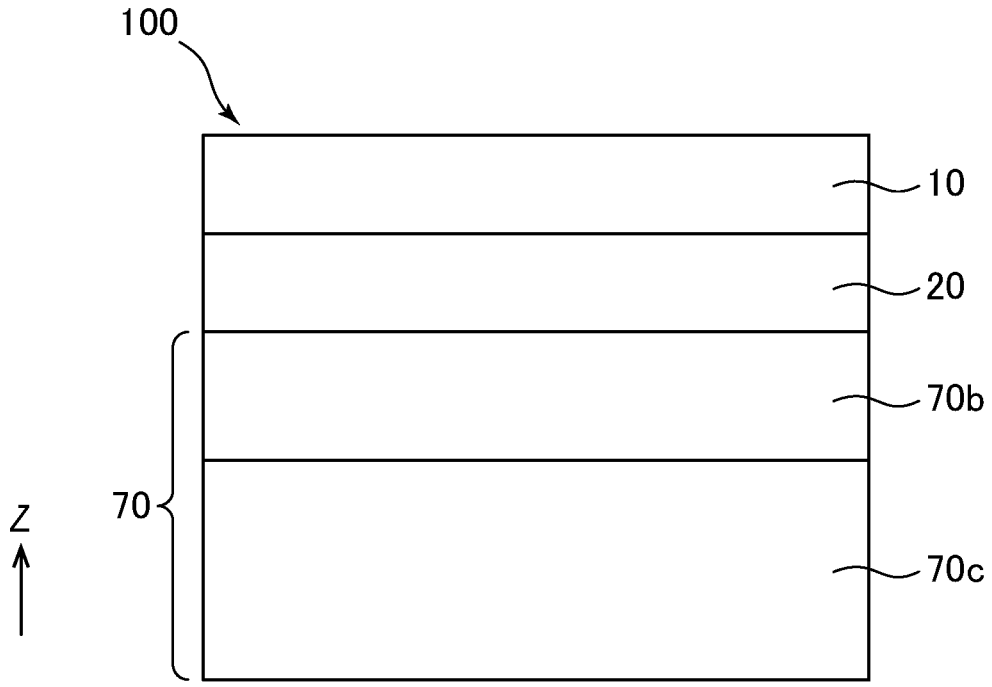
FIG. 1 is a schematic diagram illustrating the configuration of a sanitary equipment part of the present invention in which a layer of organic compound is formed on a base material.

A sanitary equipment part of the present invention is a sanitary equipment part including: a base material having a metal element at least on a surface thereof; a layer of metal oxide formed on the surface of the base material; and a layer of organic compound provided on the layer of metal oxide, wherein the metal element is at least one selected from the group consisting of Cr, Zr, and Ti, the layer of metal oxide contains at least the metal element and an oxygen element, and the layer of organic compound binds to the layer of metal oxide by binding the metal element (M) via an oxygen atom (0) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group.

A layer of metal oxide is required in order for the compound represented by R—X to be bonded to the surface of the sanitary equipment part. The surface of the layer of metal oxide is hydrophilic, but by forming a layer of organic compound on the surface, it becomes water-repellent and exhibits scale adhesion preventing performance. Therefore, it has been considered preferable to form the layer of organic compound by using a fluorine atom-containing compound as described in Japanese Patent Application Publication No. 2004-217950 because a highly water-repellent surface can be obtained. However, the inventors have found that the scale adhesion preventing performance is lowered on the surface of a layer of organic compound formed by using a fluorine atom-containing compound. This is presumably because a complex action takes place between a repulsive force acting on water due to a very high water repellency of the fluoroalkyl group and an attractive force acting on water due to the hydrophilicity of the layer of metal oxide, and thus water infiltrates the layer of organic compound to promote the bond between the inorganic components (silicates and the like) dissolved in water and the metal oxide, resulting in the promotion of adhesion of scales.

On the other hand, the inventors have found that, when a layer of organic compound is formed by using a fluorine-free compound such as an alkylphosphonic acid having a linear hydrocarbon group, the scale adhesion preventing performance is high, and scale removal performance can be obtained (First Effect). This is presumably because the layer of organic compound formed by using a fluorine-free compound has lower water repellency than a layer of organic compound formed by using a fluorine atom-containing compound, and thus the action of water infiltrating the side of the layer of metal oxide is weak.

In addition, being able to prevent water from infiltrating the layer of organic compound is considered to be advantageous in enhancing the durability of the layer of organic compound. The bond between R—X and the metal oxide can be hydrolyzed in the presence of water. Thus, the present inventors have also found that, when a layer of organic compound formed by using a fluorine atom-containing compound or the like and easily infiltrated with water is used in an environment where water is present, R—X is desorbed from the metal oxide, making it impossible to maintain the scale removal performance.

On the other hand, in the case of using an alkylphosphonic acid or the like having a linear hydrocarbon group that can prevent the infiltration of water, hydrolysis of the bond between R—X and the metal oxide is less likely to take place, making it possible to maintain the scale removal performance. Moreover, when the layer of metal oxide contains at least one metal element (M) selected from the group consisting of Cr, Zr, and Ti, it is possible to form a stable bond (M-O—P bond) between the layer of metal oxide and R—X. Therefore, even when water slightly infiltrates the layer of organic compound, it is possible to suppress desorption of R—X due to the hydrolysis of the bond between R—X and the metal oxide. Such a stable M-O—P bond gives the layer of organic compound durability when used in an environment where water is present or when sliding for cleaning (Second Effect).

From the above, the sanitary equipment part of the present invention can ensure sufficient durability by having both scale removal performance (First Effect) and durability of the layer of organic compound (Second Effect).

Hereinafter, detailed embodiments of the present invention are described.

As illustrated in FIG. 1, the sanitary equipment part of the present invention is a sanitary equipment part 100 including a base material 70 having a metal element at least on a surface thereof, a layer 20 of metal oxide containing a metal element, and a layer 10 of organic compound provided on the layer 20 of metal oxide. The direction from the base material 70 toward the layer 10 of organic compound is defined as a Z direction. The base material 70, the layer 20 of metal oxide, and the layer 10 of organic compound are arranged in this order in the Z direction.

In the present invention, the layer 10 of organic compound is a layer formed by using R—X described later, and is preferably a monolayer, and more preferably a self-assembled monolayer (SAM). Since the self-assembled monolayer is a layer in which molecules are densely assembled, most of the hydroxyl groups existing on the surface of the layer of metal oxide can be shielded. A molecule that can be self-assembled has a structure of a surfactant, and has a functional group (head group) having a high affinity with the layer of metal oxide and a moiety having a low affinity with the layer of metal oxide. Surfactant molecules having a phosphonic acid group, a phosphoric acid group, and a phosphinic acid group as head groups have an ability to form SAM on the surface of a layer of metal oxide. The thickness of the SAM is about the same as the length of one constituent molecule. Here, the "thickness" refers to the length of the SAM in the Z direction, and does not necessarily mean the length of the R—X itself. The thickness of the SAM is 10 nm or less, preferably 5 nm or less, and more preferably 3 nm or less. In addition, the thickness of the SAM is 0.5 nm or more, and preferably 1 nm or more. In the case of using constituent molecules such that the thickness of SAM falls within such a range, it is possible to efficiently coat the layer of metal oxide, and to obtain a sanitary equipment part having excellent removal performance on pollutants.

In the present invention, SAM is an aggregate of molecules formed on the surface of a base material in the process of organic molecules adsorbing to the surface of a solid, and the interaction between the molecules causes the molecules constituting the aggregate to densely aggregate. In the present invention, the SAM contains hydrocarbon groups. As a result, hydrophobic interaction acts between the molecules and allows the molecules to densely assemble, so that it is possible to obtain a sanitary equipment part having excellent scale removal performance.

In the present invention, SAM is a layer formed by using a compound represented by the general formula R—X (R is a hydrocarbon group or a group having an atom other than carbon at one or two positions in the hydrocarbon group, and X is at least one selected from a phosphonic acid group, a phosphoric acid group, and a phosphinic acid group).

In the present invention, the layer 10 of organic compound is a layer formed by using R—X. R is a hydrocarbon group made up of C and H. In addition, R may have an atom other than carbon at one or two positions in the hydrocarbon group. The number of carbons in R is preferably 6 or more and 25 or less, and more preferably 10 or more and 18 or less. The atoms to be substituted include oxygen, nitrogen, and sulfur. Preferably, one end of R, which is an end that is not a bonding end with X, is made up of C and H, for example a methyl group. As a result, the surface of the sanitary equipment part becomes water-repellent, making it possible to improve the scale removal performance.

More preferably, R is a hydrocarbon group made up of C and H. The hydrocarbon group may be a saturated hydrocarbon group or an unsaturated hydrocarbon group. In addition, it may be an open chain hydrocarbon, or may contain a cyclic hydrocarbon such as an aromatic ring. R is preferably an open chain saturated hydrocarbon group, and more preferably a straight-chain saturated hydrocarbon group. Since the open chain saturated hydrocarbon group is a flexible molecular chain, it is possible to cover the surface of the layer of metal oxide without gaps and improve water resistance. When R is an open chain hydrocarbon group, it is preferably an alkyl group having 6 or more and 25 or less carbon atoms. R is more preferably an alkyl group having 10 or more and 18 or less carbon atoms. When the number of carbon atoms is large, the interaction between the molecules is large, so that it is possible to shorten the distance between alkyl chains, making it possible to further improve the water resistance. On the other hand, too large a number of carbon atoms results in slow formation rate of monolayer and deterioration of the production efficiency.

In the present invention, it is preferable that R is free of a halogen atom, particularly a fluorine atom. It is preferable that R is free of a highly polar functional group (sulfonic acid group, hydroxyl group, carboxylic acid group, amino group, or ammonium group) or heterocyclic skeleton on one end side. A layer formed by using a compound free of halogen atom or these functional groups is high in scale removal performance and its durability.

X is at least one selected from a phosphonic acid group, a phosphoric acid group, and a phosphinic acid group among functional groups containing a phosphorus atom, and is preferably a phosphonic acid group. As a result, it is possible to efficiently obtain a sanitary equipment part having high water resistance and excellent removal performance on pollutants.

The organic phosphonic acid compound represented by the general formula R—X is preferably octadecylphosphonic acid, hexadecylphosphonic acid, dodecylphosphonic acid, decylphosphonic acid, octylphosphonic acid, hexylphosphonic acid, and decyloxy methylphosphonic acid, and more preferably octadecylphosphonic acid, hexadecylphosphonic acid, dodecylphosphonic acid, and decylphosphonic acid. Further, octadecylphosphonic acid is more preferable.

In the present invention, the layer of organic compound may be formed by using two or more types of R—X. The layer of organic compound formed of two or more types of R—X means a layer of organic compound formed by mixing multiple types of the above-mentioned compounds. In addition, in the present invention, the layer of organic compound may contain a trace amount of organic molecules other than R—X as long as the scale removal performance is not impaired.

Figure 2:
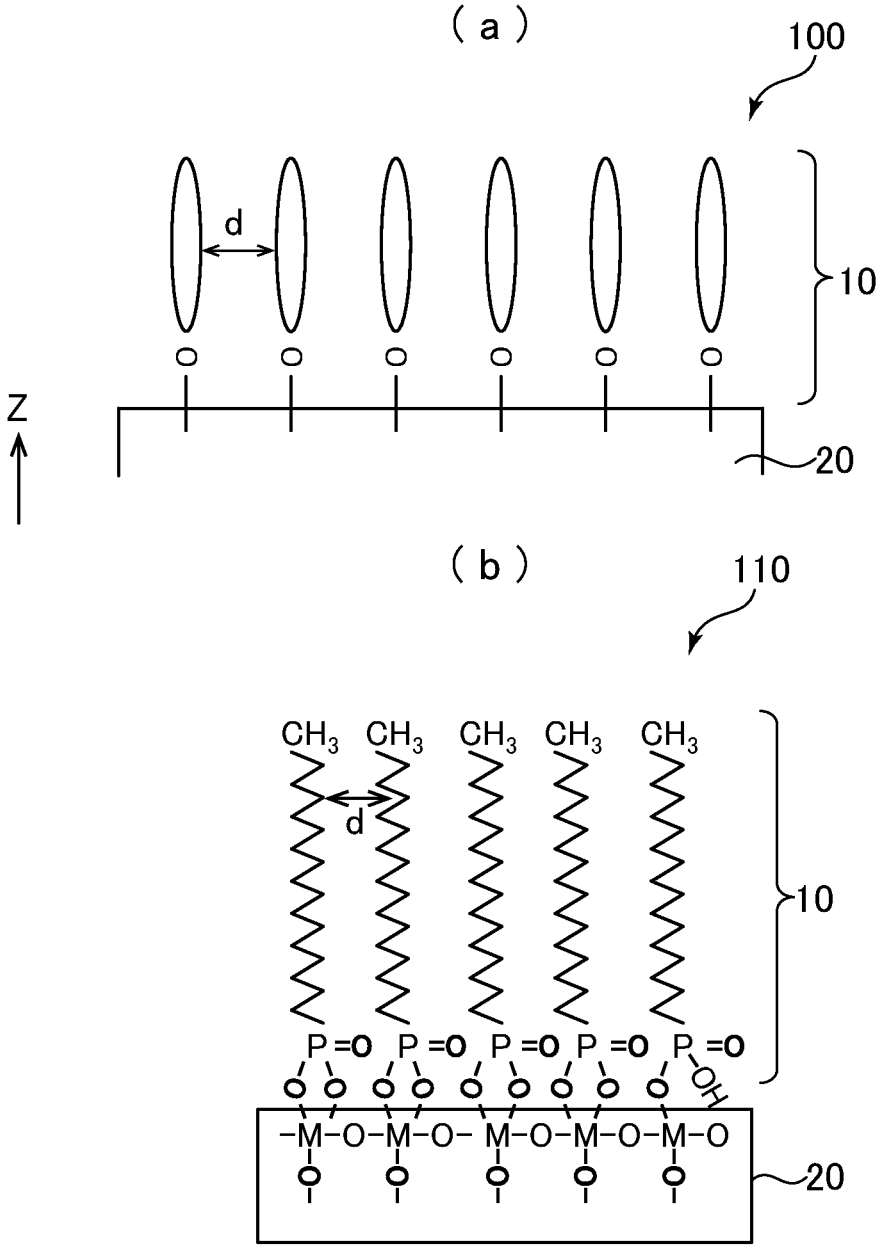
FIG. 2 is a schematic diagram illustrating at the molecular level the layer of organic compound formed on the base material in the sanitary equipment part of the present invention.

In the present invention, the mechanism for improving the scale removal performance and its durability is as described above, but in addition to that, the following can be inferred. Specifically, as illustrated in FIG. 2(*a*), when R—X is used, the distance d between the R's constituting the layer 10 of organic compound on the surface of the sanitary equipment part 100 is small, which suppresses the binding of scales to the hydroxyl groups of the layer of metal oxide. Based on the above inference, the removal performance is considered to improve. Here, the "distance d" is a distance between the R's. Moreover, since the flexible R is bent to cover the base material, it becomes difficult for water molecules to infiltrate the bonding site between the base material and the compound forming the layer of organic compound. Thus, hydrolysis is less likely to take place at the bond between the compound forming the layer of organic compound and the metal oxide. Based on the above inference, the water resistance is considered to improve.

Figure 3:
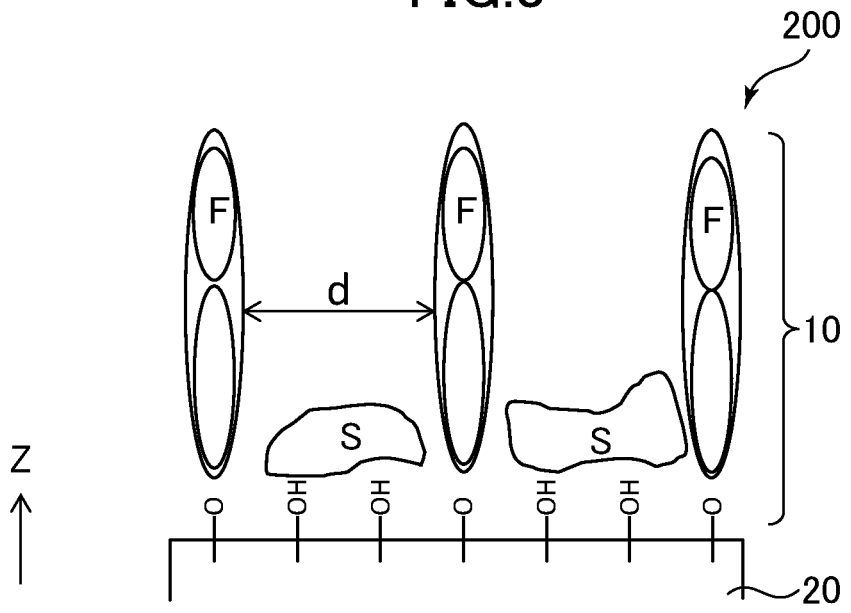
FIG. 3 is a schematic diagram illustrating at the molecular level a layer of organic compound formed on a base material in a conventional metal part.

On the other hand, in the techniques disclosed in Japanese Patent Application Publication No. 2000-265526 and Japanese Patent Application Publication No. 2004-217950, a hydrocarbon group containing a fluorine atom is used. In this case, since (i) the molecule size is large and the molecules cannot be arranged densely due to steric hindrance of the molecule, and (ii) the interaction between the molecules is weak, the distance d between the fluorine-containing hydrocarbon groups constituting the layer 10 of organic compound becomes wide in the part 200, as illustrated in FIG. 3. Thus, it is presumed that unshielded hydroxyl groups remain on the surface of the layer of metal oxide and form a chemical bond with the scale S, so that sufficient scale removal performance cannot be obtained. In addition, since the fluorine-containing hydrocarbon groups are rigid molecular chain molecules, they cannot further cover the gaps between the molecules. Therefore, it is presumed that water molecules are likely to infiltrate into the bonding site between the base material and the layer of organic compound, and the water resistance is lowered.

The upper limit of the thickness of the layer of organic compound is preferably 50 nm or less, more preferably 20 nm or less, and further preferably 10 nm or less. The lower limit of the thickness of the layer of organic compound is preferably 0.5 nm or more, and more preferably 1 nm or more. A suitable range can be formed by appropriately combining these upper limit values and lower limit values. Here, the "thickness" refers to the length of the layer of organic compound in the Z direction.

As a method of measuring the thickness of the layer of organic compound, it is possible to use any one of X-ray photoelectron spectroscopy (XPS), X-ray reflectometry (XRR), ellipsometry, and surface enhanced Raman spectroscopy, and in the present invention, the thickness of the layer of organic compound is measured by XPS. Even when the layer of organic compound is formed of two or more types of R—X, the thickness measured by XPS is regarded as the average thickness of the layer of organic compound, and the thickness obtained by the measurement presented below is defined as the thickness of the layer of organic compound. In that case, the thickness of the layer of organic compound can be measured by so-called XPS depth profile measurement in which argon ion beam sputtering or argon gas cluster ion beam (Ar-GCIB) sputtering is used in combination with XPS measurement to sequentially perform surface composition analysis with the ion sputtered surfaces after removal of layer step by step (see FIGS. 6 and 7 described later). The depth distribution curve obtained by such XPS depth profile measurement can be created with the vertical axis representing each atomic concentration (unit: at %) and the horizontal axis representing the sputtering time. In the depth distribution curve with the horizontal axis as the sputtering time, the sputtering time generally correlates with the distance from the surface in the depth direction. As the distance from the surface of the sanitary equipment part (or the layer of organic compound) in the Z direction, the distance from the surface of the sanitary equipment part (or the layer of organic compound) can be calculated from the relationship between the sputtering rate and the sputtering time employed in the XPS depth profile measurement.

In the case of argon ion beam sputtering, the measurement point with a sputtering time of 0 minutes is set to the surface (0 nm), and the measurement is performed until the depth is 20 nm from the surface. The carbon atom concentration in the base material is defined as the carbon concentration at a depth of about 20 nm from the surface. The carbon atom concentration is measured in the depth direction from the surface, and the maximum depth at which the carbon atom concentration is higher by 1 at % or more than the carbon atom concentration of the base material is evaluated as the thickness of the layer of organic compound.

In addition, in the case of Ar-GCIB, the thickness of the layer of organic compound is evaluated as follows. First, the standard sample of film thickness prepared is a standard sample in which a layer of organic compound formed by using octadecyltrimethoxysilane is formed on a silicon wafer, and X-ray reflectometry (XRR) (X'pert pro manufactured by PANalytical Ltd.) is performed to obtain a (X-ray) reflectivity profile. For the obtained (X-ray) reflectivity profile, analysis software (X'pert Reflectivity) is used to perform fitting to the multilayer film model of Parratt and the roughness formula of Nevot-Crosse, to thereby obtain the film thickness of the standard sample. Next, Ar-GCIB measurement is performed on the standard sample to obtain the sputtering rate (nm/min) of SAM. For the film thickness of the layer of organic compound on the surface of the sanitary equipment part, the obtained sputtering rate is used to convert the sputtering time into the distance from the surface of the sanitary equipment part in the Z direction. The XRR measurement and analysis conditions and the Ar-GCIB measurement conditions are as follows.

(XRR Measurement Conditions)
Device: X'pert pro (PANalytical Ltd.)
X-ray source: CuKα
Tube voltage: 45 kV
Tube current: 40 mA
Incident Beam Optics
Divergence slit: ¼°
Mask: 10 mm
Solar slit: 0.04 rad
Anti-scattering slit: 1°
Diffracted Beam Optics
Anti-scattering slit: 5.5 mm
Solar slit: 0.04 rad
X-ray detector: X'Celerator
Pre Fix Module: Parallel plate Collimator 0.27
Incident Beam Optics: Beam Attenuator Type Non
Scan mode: Omega
Incident angle: 0.105-2.935

(XRR Analysis Conditions)
The following initial conditions are set.
Layer sub: Diamond Si (2.4623 g/cm3)
Layer 1: Density Only SiO2 (2.7633 g/cm3)
Layer 2 Density Only C (1.6941 g/cm3)

(Ar-GCIB Measurement Conditions)
Device: PHI Quantera II (manufactured by ULVAC-PHI, Inc.)
X-ray conditions: monochromatic AlKα ray, 25 W, 15 kv
Analysis area: 100 my
Charge neutralizer setting: 20 μA
Ion gun setting: 7.00 mA
Photoelectron take-off angle: 45°
Time per step: 50 ms
Sweep: 10 times
Pass energy: 112 eV
Measurement interval: 10 min
Spatter-setting: 2.5 kV
Binding Energy: Depends on the Measurement Element For the measurement sample, the measurement point with a sputtering time of 0 minutes is set as the surface (0 nm), and the measurement is performed up to a sputtering time of 100 minutes. Note that in the measurement of the thickness of the layer of organic compound, argon ion beam sputtering is employed to obtain an approximate value in a semi-quantitative manner, and high depth-resolution (because of soft ion beam sputtering technic) Ar-GCIB is used to obtain a thickness in a quantitative manner.

In the present invention, when measuring the thickness of the layer of organic compound on the surface, the surface of the sanitary equipment part is washed before the measurement to sufficiently remove the stains adhering to the surface. For example, wipe washing with ethanol and sponge slide washing with a neutral detergent are followed by thorough rinse washing with ultrapure water. Further, in the case of a rough-surfaced sanitary equipment part whose surface has been subjected to hairline processing, shot blasting, or the like, a portion with as high surface smoothness as possible is selected and measured.

In the present invention, before confirming in detail that the layer of organic compound is a layer formed by using R—X by the method presented below, it may be simply confirmed by measuring C—C bonds and C—H bonds that the layer of organic compound is formed by using a compound having R. The C—C bond and the C—H bond can be confirmed by X-ray photoelectron spectroscopy (XPS), surface enhanced Raman spectroscopy, and infrared reflection absorption spectroscopy (IRRAS). When XPS is used, the spectrum in the range where the Cls peak appears (278 to 298 eV) is obtained, and the peak near 284.5 eV derived from the C—C bond and the C—H bond is confirmed. When measuring the C—C bond and the C—H bond, the surface of the sanitary equipment part is washed before the measurement to sufficiently remove the stains adhering to the surface.

In the present invention, before confirming in detail that the layer of organic compound is a layer formed by using R—X by the method presented below, it may be simply confirmed that the layer of organic compound is formed by using a compound having X by measuring a phosphorus atom (P) or a bond between a phosphorus atom (P) and an oxygen atom (O) (P—O bond). Phosphorus atoms can be confirmed by determining the phosphorus atom concentration by X-ray photoelectron spectroscopy (XPS). The P—O bond can be confirmed by, for example, surface enhanced Raman spectroscopy, infrared reflection absorption spectroscopy, and X-ray photoelectron spectroscopy (XPS). When XPS is used, the spectrum in the range where the P2p peak appears (122 to 142 eV) is obtained, and the peak near 133 eV derived from the P—O bond is confirmed.

In the present invention, it is confirmed in detail by the following procedure that the layer of organic compound is a layer formed by using R—X. First, surface elemental analysis is performed by XPS analysis, and it is confirmed that C, P, and O are detected. Next, the molecular structure is specified by mass spectrometry from the mass-to-charge ratio (m/z) derived from the molecules of the components existing on the surface. For mass spectrometry, time-of-flight secondary ion mass spectrometry (TOF-SIMS) or high resolution mass spectrometry (HR-MS) can be used. Here, the high resolution mass spectrometry (HR-MS) refers to a method in which the mass resolution can be measured with an accuracy of less than 0.0001 u (u: unified atomic mass units) or 0.0001 Da, and the elemental composition can be estimated from the precise mass. The HR-MS includes double-focusing mass spectrometry, time-of-flight tandem mass spectrometry (Q-TOF-MS), Fourier transform ion cyclotron resonance mass spectrometry (FT-ICR-MS), Orbitrap mass spectrometry, and the like, and the present invention uses time-of-flight tandem mass spectrometry (Q-TOF-MS). For mass spectrometry, it is desirable to use HR-MS when sampling of R—X in a sufficient amount from the part is possible. On the other hand, when sampling of R—X in a sufficient amount from the part is impossible due to the small size of the part or the like, it is desirable to use TOF-SIMS. When mass spectrometry is used, the presence of R—X can be confirmed by detecting the ionic intensity of m/z corresponding to the ionized R—X. Here, it is regarded that the ionic intensity is detected by having three times or more of the signal of the average value of 50 Da before and after, centering on m/z, which is the lowest value in the range in which the ionic intensity is calculated in the measurement range.

For the time-of-flight secondary ion mass spectrometry (TOF-SIMS) device, for example, TOF-SIMS 5 (manufactured by ION-TOF) is used. The measurement conditions are such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. In the secondary ion mass spectrum, the horizontal axis represents the mass-to-charge ratio (m/z), and the vertical axis represents the intensity of the detected ions (count).

As the high resolution mass spectrometer, a time-of-flight tandem mass spectrometer (Q-TOF-MS), for example, Triple TOF 4600 (manufactured by SCIEX) is used. In the measurement, for example, the cutout base material is immersed in ethanol, and the component (R—X) used for forming the layer of organic compound is extracted with unnecessary components filtered, transferred to a vial (about 1 mL), and then measured. MS/MS measurement is performed under the measurement conditions that ion source: ESI/Duo Spray Ion Source, ion mode (Positive/Negative), IS voltage (−4500 V), source temperature (600° C.), DP (100 V), and CE (40 V), for example. As a measurement result, an MS/MS spectrum is obtained. In the MS/MS spectrum, the horizontal axis represents the mass-to-charge ratio (m/z), and the vertical axis represents the intensity of the detected ions (count).

Confirmation that one end of R is made up of C and H and that R is a hydrocarbon made up of C and H is confirmed by using surface enhanced Raman spectroscopy.

When surface enhanced Raman spectroscopy is used, it is performed by confirming a Raman shift ($cm^{-1}$) derived from the fact that one end of R is made up of C and H and that R is a hydrocarbon made up of C and H. The surface enhanced Raman spectroscopy analyzer includes a transmission-type plasmonic sensor (for surface enhanced Raman spectroscopy) and a confocal microscope Raman spectrometer. As the transmission-type plasmonic sensor (for surface enhanced Raman spectroscopy), for example, the one described in Japanese Patent No. 6179905 is used. As the confocal microscope Raman spectrometer, for example, NanoFinder 30 (Tokyo Instruments, Inc.) is used. The measurement is performed with a transmission-type surface enhanced Raman sensor placed on the surface of the cutout sanitary equipment part. The measurement conditions are such that Nd: YAG laser (532 nm, 1.2 mW), scan time (10 seconds), grating (800 Grooves/mm), and pinhole size (100 μm). A Raman spectrum is obtained as a measurement result. In the Raman spectrum, the horizontal axis is Raman shift ($cm^{-1}$) and the vertical axis is signal intensity. When one end of R is a methyl group, a Raman shift (around 2930 $cm^{-1}$) derived from the methyl group is confirmed. When the end of R is a different hydrocarbon, the corresponding Raman shift is confirmed. In addition, when the hydrocarbon whose R is made up of C and H is an alkyl group (—$(CH_2)_n$—), it is confirmed by detecting a Raman shift at around 2850 $cm^{-1}$ and around 2920 $cm^{-1}$. In the case of different hydrocarbon groups, the corresponding Raman shift is confirmed. It is regarded that the Raman shift signal is detected when it is three times or more the average value of the signal intensity of 100 $cm^{-1}$ in the range where the signal intensity is the lowest in the measurement range.

TOF-SIMS can be used to confirm that R is a hydrocarbon made up of C and H. When TOF-SIMS analysis is used, confirmation is made in such a way that in the secondary ion mass spectrum obtained under the same analytical conditions as the confirmation of R—X, the peak detected every m/z=14 is derived from the alkyl group (—$(CH_2)_n$—).

Confirmation that the layer of organic compound is a monolayer can be made based on the thickness of the layer of organic compound obtained by the above method and the molecular structure of the compound represented by the general formula R—X identified by the above method. First, the molecular length of the compound represented by the general formula R—X is estimated based on the identified molecular structure. Then, when the thickness of the obtained layer of organic compound is less than twice the molecular length of the estimated compound, it is regarded as a monolayer. Note that the thickness of the layer of organic compound is the average value of the thicknesses obtained by measuring three different points. Further, when the layer of organic compound is formed of two or more types of compounds represented by the general formula R—X, and if the thickness of the obtained layer of organic compound is less than twice the longest molecular length of the estimated compound, it is regarded as a monolayer.

Confirmation that the layer of organic compound is SAM can be made by confirming that the layer of organic compound forms a dense layer in addition to the above-mentioned confirmation that the layer of organic compound is a monolayer. Confirmation that the layer of organic compound forms a dense layer can be made by the phosphorus atom concentration on the surface described above. Specifically, when the phosphorus atom concentration is 1.0 at % or more, it can be said that the layer of organic compound forms a dense layer.

As illustrated in FIG. 2(*b*), in the layer of organic compound and the layer of metal oxide, a metal atom (M) derived from the layer of metal oxide binds via an oxygen atom (O) to a phosphorus atom (P) derived from the compound R—X (M-O—P bond). For example, the M-O—P bond can be confirmed by time-of-flight secondary ion mass spectrometry (TOF-SIMS), surface enhanced Raman spectroscopy, infrared reflection absorption spectroscopy, infrared absorption spectroscopy, and X-ray photoelectron spectroscopy (XPS), and in the present invention, confirmation is made by using both time-of-flight secondary ion mass spectrometry (TOF-SIMS) and surface enhanced Raman spectroscopy in combination. When X is a phosphonic acid group, a maximum of three M-O—P bonds can be formed for one X. When one X is fixed to the metal oxide by multiple M-O—P bonds, the layer of organic compound improves in water resistance and wear resistance.

In the present invention, the M-O—P bond is confirmed by the following procedure. First, surface elemental analysis is performed by XPS analysis, and it is confirmed that C, P, and O are detected. Next, a time-of-flight secondary ion mass spectrometer (TOF-SIMS), for example, TOF-SIMS 5 (manufactured by ION-TOF) is used. The measurement conditions are such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. Confirmation is made by obtaining, as results of the measurement, a secondary ion mass spectrum derived from a combination of R—X and the metal oxide element M (R—X-M) and a secondary ion mass spectrum derived from M-O—P (m/z). In the secondary ion mass spectra, the horizontal axis represents the mass-to-charge ratio (m/z), and the vertical axis represents the intensity of the detected ions (count).

Next, a Raman shift ($cm^{-1}$) derived from M-O—P bond is confirmed by surface enhanced Raman spectroscopy analysis. The surface enhanced Raman spectroscopy analyzer includes a transmission-type plasmonic sensor (for surface enhanced Raman spectroscopy) and a confocal microscope Raman spectrometer. As the transmission-type plasmonic sensor (for surface enhanced Raman spectroscopy), for example, the one described in Japanese Patent No. 6179905 is used. As the confocal microscope Raman spectrometer, for example, NanoFinder 30 (Tokyo Instruments, Inc.) is used. The measurement is performed with a transmission-type surface enhanced Raman sensor placed on the surface of the cutout sanitary equipment part. The measurement conditions are such that Nd: YAG laser (532 nm, 1.2 mW), scan time (10 seconds), grating (800 Grooves/mm), and pinhole size (100 μm). A Raman spectrum is obtained as a measurement result. In the Raman spectrum, the horizontal axis is Raman shift ($cm^{-1}$) and the vertical axis is signal intensity. The signal derived from the M-O—P bond can be assigned from the Raman spectrum estimated for the bond state of the M-O—P bond by using the first principle calculation software package: Material Studio. As the calculation conditions for the first principle calculation, structure optimization is performed with, for example, software used (CASTEP), functional (LDA/CA-PZ), cutoff (830 eV), K point (2*2*2), pseudopotential (Norm-conserving), Dedensity mixing (0.05), spin (ON), and Metal (OFF). In addition, Raman spectrum calculation is performed with, for example, software used (CASTEP), functional (LDA/CA-PZ), cutoff (830 eV), K point (1*1*1), pseudopotential (Norm-conserving), Dedensity mixing (All Bands/EDFT), spin (OFF), and Metal (OFF). For example, in the case of phosphonic acid group, the possible M-O—P bond states include a state where there is one M-O—P bond for one phosphonic acid group, a state where there are two M-O—P bonds for one phosphonic acid group, and a state where there are three M-O—P bonds for one phosphonic acid group. It is confirmed that the sanitary equipment part of the present invention contains at least one of the bond states. When the Raman spectrum obtained from surface enhanced Raman spectroscopy analysis is assigned by the Raman spectrum obtained by first principle calculation, it is confirmed that the characteristic Raman shifts match at two or more points for each M-O—P bond state. Here, the fact that the Raman shifts match means that the signal is detected by both the first principle calculation and the surface enhanced Raman spectroscopy analysis in the range of ±2.5 $cm^{-1}$ (5 $cm^{-1}$) of the Raman shift value considered to be derived from the M-O—P bond to be compared.

In the sanitary equipment part of the present invention, the phosphorus atom concentration on the surface is preferably 1.0 at % or more and less than 10 at %. By setting the phosphorus atom concentration in this range, it is shown that the layer of organic compound is dense. As a result, it is possible to obtain a sanitary equipment part having sufficient water resistance and excellent scale removal performance. More preferably, the phosphorus atom concentration is 1.5 at % or more and less than 10 at %. As a result, water resistance and scale removal performance can be further improved.

The phosphorus atom concentration on the surface of the sanitary equipment part of the present invention can be determined by X-ray photoelectron spectroscopy (XPS). Wide scan analysis (also referred to as survey analysis) is performed using condition 1 as the measurement condition.

(Condition 1)

X-ray condition: monochromatic AlKα ray (output 25 W)

Photoelectron take-off angle: 45°

Analysis area: 100 μmφ

Scanning range: 15.5 to 1100 eV

As the XPS device, PHI Quantera II (manufactured by ULVAC-PHI, Inc.) can be used. The spectrum is obtained by wide scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (280 eV), and scanning range (15.5 to 1100 eV). The spectrum is measured in a form containing carbon atoms, phosphorus atoms, and the like detected from the layer of organic compound, and atoms detected from the base material, for example in the case of a Cr-plated base material, chromium atoms and oxygen atoms. The concentration of the detected atoms can be calculated from the obtained spectrum by using, for example, data analysis software PHI MultiPak (manufactured by ULVAC-PHI, Inc.). The obtained spectrum is subjected to charge correction with the C1s peak set to 284.5 eV. Then, the Shirley method is carried out on the obtained peaks based on the electron orbits of the atoms to remove the background, and thereafter the peak area intensity is calculated. Analysis processing is performed that divides by the relative sensitive factors (RSF) for XPS preset in the data analysis software. In this way, the phosphorus atom concentration (hereinafter $C_P$) can be calculated. Further, in the same manner, the carbon atom concentration (hereinafter, $C_C$), the oxygen atom concentration (hereinafter, $C_O$), and the metal atom concentration (hereinafter, $C_M$) can be obtained. For the concentration calculation, the peak areas used are P2p peak for phosphorus, C1s peak for carbon, O1s peak for oxygen, Cr2p3 peak for chromium, Ti2p peak for titanium, and Zr3d peak for zirconium.

In the present invention, when the surface is analyzed, a portion having a relatively large radius of curvature is selected from the sanitary equipment part and cut into an analyzable size as a measurement sample. At the time of cutting, the portion to be analyzed•evaluated is covered with a film or the like to prevent surface damage. The surface of the sanitary equipment part is washed before the measurement to sufficiently remove the stains adhering to the surface. For example, sponge slide washing with a neutral detergent is followed by thorough rinse washing with ultrapure water. In the present invention, the elements detected by XPS analysis are carbon, oxygen, phosphorus, and atoms derived from the base material and the layer of metal oxide. The atoms derived from the base material and the layer of metal oxide may contain nitrogen and the like in addition to the metal atoms constituting the base material and the layer of metal oxide. When the base material contains chromium plating, carbon, oxygen, phosphorus, and chromium are detected. When any other element is detected, it is considered to be a pollutant adhering to the surface of the layer of metal oxide. When a high concentration of pollutant-derived atoms is detected (when the concentration of pollutant-derived atoms exceeds 3 at %), it is regarded as an abnormal value. If an abnormal value is obtained, the atomic concentration is calculated by excluding the abnormal value. If there are many abnormal values, the surface of the sanitary equipment part is cleaned again, and the measurement is redone. In addition, when the sanitary equipment part is a rough-surfaced metal part whose surface has been subjected to hairline processing, a portion with as high surface smoothness as possible is selected and measured.

In the sanitary equipment part of the present invention, the carbon atom concentration on the surface thereof is preferably 35 at % or more, more preferably 40 at % or more, further preferably 43 at % or more, and most preferably 45 at % or more. In addition, the carbon atom concentration is preferably less than 70 at %, more preferably 65 at % or less, and further preferably 60 at % or less. The preferable range of the carbon atom concentration can be appropriately combined with these upper limit values and lower limit values. By setting the carbon atom concentration in such a range, it is possible to improve the scale removal performance.

The carbon atom concentration (hereinafter referred to as $C_C$) on the surface of the sanitary equipment part of the present invention can be determined by X-ray photoelectron spectroscopy (XPS) in the same manner as the measurement of the phosphorus atom concentration. Wide scan analysis is performed using the above-mentioned condition 1 as the measurement condition.

The sanitary equipment part of the present invention includes a base material 70 having a metal element at least on a surface thereof, and a layer 20 of metal oxide formed on the base material 70. The layer 20 of metal oxide is a layer containing at least the metal element and an oxygen element. The layer 20 of metal oxide contains the metal element in an oxidized state. There is no need for a clear boundary between the base material 70 and the layer 20 of metal oxide. The metal element is such that a pure metal or alloy containing the element can form a passivation film, and in the present invention, it is at least one selected from the group consisting of Cr, Zr, and Ti. By setting the metal element in such a scope, a stable passivation layer can be formed on the surface of the base material. Here, the stable passivation layer refers to a layer containing a metal oxide and having sufficient water resistance. More preferably, the metal element is Cr or Zr. By setting the metal element in such a scope, the layer of metal oxide on the surface of the base material becomes a more stable passivation layer, and the water resistance can be further improved. The metal element can be determined by X-ray photoelectron spectroscopy (XPS).

In addition to the above-mentioned elements, Ni and Al are also known as metal elements that can form a passivation film. However, it has been found that the application of a layer of metal oxide made up of Ni or Al and an oxygen element to a sanitary equipment part tends to reduce scale removability and moreover to exhibit poor appearance due to the generation of spots distributed over a wide area. For this reason, application to a sanitary equipment part, where aesthetics are particularly important for users, is not preferable. It is considered that the deterioration of scale removability and the occurrence of poor appearance are due to the infiltration of water into the layer of organic compound caused by the long-term use of the sanitary equipment part and the deterioration of the layer of metal oxide.

The layer 20 of metal oxide is a passivation layer formed on the surface of the base material 70, or a layer artificially formed on the surface of the base material 70, and is preferably a passivation layer in that it is possible to obtain a layer of organic compound having excellent durability such as water resistance and wear resistance. As the means of artificially formation, for example, any one of a sol-gel method, chemical vapor deposition (CVD), and a physical vapor deposition (PVD) can be mentioned.

In addition, the base material 70 may include a region 70*b*. The region 70*b* is, for example, a layer containing a metal formed by metal plating or physical vapor deposition (PVD). The region 70*b* may be made up of only metal elements, or may be included in the form of metal nitrides (such as TiN and TiAlN), metal carbides (such as CrC), and metal carbonitrides (such as TiCN, CrCN, ZrCN, and ZrGaCN). The base material 70 includes a support member 70*c*. The material of the support member 70*c* may be metal, resin, ceramic, pottery, or glass. The region 70*b* may be formed directly on the support body 70*c*, or may include a different layer between the region 70*b* and the support body 70*c*. For example, the base material 70 which is provided with the region 70*b* includes a metal-plated product in which the region 70*b* is provided by a metal plating treatment on the support member 70*c* made of brass or resin. On the other hand, for example, the base material 70 which cannot be provided with the region 70*b* includes a metal molded product such as stainless steel (SUS). The surface texture of the base material 70 is not particularly limited, and can be applied to a glossy mirror surface, a satin finish, or a matte surface such as a hairline.

In the sanitary equipment part of the present invention, the oxygen atom/metal atom concentration ratio (O/M ratio) on the surface thereof is preferably greater than 1.7, and more preferably 1.8 or more. By setting the O/M ratio in such a range, the sanitary equipment part of the present invention can strongly bond a dense layer of organic compound to a layer of metal oxide having a relatively high degree of oxidation, and thus water resistance and wear resistance can be further improved.

The O/M ratio (Rum) can be calculated by the formula (A) using the above $C_O$ and $C_M$ obtained by XPS analysis.

$$R_{O/M}=C_O/C_M \quad \text{formula (A)}$$

Note that in the case of calculating Rum when R contains an ether group or a carbonyl group, it can be calculated based on the formula (B), keeping in mind that $C_O$ is the sum of the oxygen atom concentration $C_{O'}$ derived from R—X and the oxygen atom concentration derived from the metal base material.

How to find $C_{O'}$: from the molecular structure specified by TOF-SIMS or HR-MS, the ratio of oxygen atoms to carbon atoms contained in R is used to make a relative comparison with $C_C$, and the oxygen atom concentration $C_{O'}$ contained in R is estimated.

$$R_{O/M}=(C_O-C_{O'})/C_M \quad \text{formula (B)}$$

In the sanitary equipment part of the present invention, the oxidized state of the metal element in the layer of metal oxide can be confirmed by XPS. Narrow scan analysis is performed using condition 2 as the measurement condition.

(Condition 2)

X-ray condition: monochromatic AlKα ray (output 25 W)

Photoelectron take-off angle: 45°

Analysis area: 100 μmφ

Scanning Range: Different for Each Element (See Next Paragraph)

As the XPS device, PHI Quantera II (manufactured by ULVAC-PHI, Inc.) can be used. The spectrum of each metal element peak is obtained by narrow scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), and Pass energy (112 eV). For example, when the metal element contained in the layer of metal oxide is Cr, the spectrum of the Cr2p3 peak can be obtained by narrow scan analysis in the range of 570 to 590 eV. Chromium (Cr) in the oxidized state can be confirmed by the presence of a peak near 577 eV. Titanium (Ti) in the oxidized state can be confirmed by the presence of the peak near 469 eV in the spectrum of the Ti2p peaks. Zirconium (Zr) in the oxidized state can be confirmed by the presence of the peak near 182 eV among the Zr3d peaks.

In the sanitary equipment part of the present invention, a water droplet contact angle on the surface thereof is preferably 90° or more, and more preferably 100° or more. The water droplet contact angle means a static contact angle, and is obtained by dropping 2 μl of water droplet on the base material and photographing the water droplet after 1 second from the side surface of the base material. As the measuring device, for example, a contact angle meter (model number: SDMs-401, manufactured by Kyowa Interface Science Co., Ltd.) can be used.

In the present invention, the "sanitary equipment" is a water supply and drainage equipment of a building or indoor equipment, and is preferably indoor equipment. Further, it is preferably used in an environment exposed to water.

In the present invention, the environment exposed to water may be any place where water is used, and includes places where water is used, such as houses and public facilities like as parks, commercial facilities, and offices. Such places preferably include bathrooms, toilet spaces, dressing rooms, washrooms, kitchens, and the like.

In the present invention, the indoor equipment is used in houses and public facilities such as commercial facilities and is touched by humans, and is preferably equipment used in bathrooms, toilet spaces, dressing rooms, washrooms, kitchens, and the like. The sanitary equipment part of the present invention used as indoor equipment includes products such as plated or PVD-coated ones. Specific examples include faucets, drain fittings, water blocking fittings, washbasins, doors, shower heads, shower bars, shower hooks, shower hoses, handrails, towel hangers, kitchen counters, kitchen sinks, drainage baskets, kitchen hoods, ventilation fans, drains, toilet bowls, urinals, electronic bidets, lids for electronic bidets, nozzles for electronic bidets, operation panels, operation switches, operation levers, handles, and doorknobs. The sanitary equipment part of the present invention is preferably a faucet, a faucet fitting, a drain fitting, a water blocking fitting, a washbasin, a shower head, a shower bar, a shower hook, a shower hose, a handrail, a towel hanger, a kitchen counter, a kitchen sink, or a drainage basket. In particular, the sanitary equipment part of the present invention can be suitably used as a faucet or as a faucet for discharging hot water.

A sanitary equipment part with a densely formed layer of organic compound, that is, a sanitary equipment part having a phosphorus atom concentration of 1.0 at % or more on the surface thereof, or a sanitary equipment part in which the layer of organic compound is SAM has excellent durability of the layer of organic compound even when exposed to warm water, and thus can be suitably used as a faucet for discharging hot water.

Preferably, the sanitary equipment part of the present invention can be produced by a method including: preparing a base material; increasing a degree of oxidation of a surface of the base material; and applying a compound represented by a general formula R—X, where R is a hydrocarbon group, and X is at least one selected from a phosphonic acid group, a phosphoric acid group, and a phosphinic acid group. A specific example thereof is presented below.

In the present invention, a layer of organic compound is formed by washing a base material containing a metal element on the surface thereof and then bringing a solution containing a compound represented by the general formula R—X into contact with the base material. It is preferable that the base material is subjected to a passivation treatment in advance to increase the degree of oxidation on the surface thereof to sufficiently form a layer of metal oxide. As the passivation treatment, in addition to the known methods, ultraviolet irradiation, ozone exposure, wet treatment, and combinations thereof can be preferably used. The method of bringing the solution into contact with the base material is not particularly limited, and examples thereof include an immersion method in which the base material is immersed in a solution, a coating method by spraying or wiping, and a mist method in which the base material is brought into contact with the mist of the solution. Preferably, the layer of organic compound is formed by an immersion method in which the base material is immersed in a solution. The temperature and immersion time when the base material is immersed in a solution vary depending on the type of the base material and the organic phosphonic acid compound, but are generally 0° C. or higher and 60° C. or lower, and 1 minute or longer and 48 hours or shorter. In order to form a dense layer of organic compound, it is preferable to lengthen the immersion time. It is preferable to form the layer of organic compound on the base material and then heat the base material. Specifically, it is heated so that the base material temperature is 40° C. or higher and 250° C. or lower, and preferably 60° C. or higher and 200° C. or lower. As a result, the bond between the components constituting the layer of organic compound and the base material is promoted, making it possible to increase the number of M-O—P bonds per phosphonic acid group. Thus, the layer of organic compound improves in water resistance and wear resistance.

EXAMPLES

The present invention is described in more detail with reference to the following Examples. The present invention is not limited to these Examples.

1. Sample Preparation 1-1. Base Material

The base materials used were plates plated with nickel chrome on brass (samples 1 to 7, 12 to 14, 16 to 18, and 20), plates (samples 8 to 10 and 15) in which a surface containing metal is formed by physical vapor deposition (PVD) on a plate plated with nickel chrome on brass, a stainless steel plate (SUS 304) (sample 11), a brass plate (sample 19), and an aluminum plate (sample 21). In order to remove stains on the surface of the base materials, the base materials were ultrasonically washed with an aqueous solution containing a neutral detergent, and the base materials were sufficiently washed away with running water after washing. Further, in order to remove the neutral detergent of the base materials, ultrasonic cleaning was performed with ion-exchanged water, and then water was removed with an air duster.

Moreover, a faucet fitting (product number: TENA40A, manufactured by TOTO Ltd.; sample 22) plated with nickel chrome on brass was used. The stains on the surface of the base materials were removed in the same manner as described above. Each of samples 1 to 18, 20, and 22 is provided with a layer of metal oxide made up of a passivation layer on the surface of the base material. Sample 20 does not have a layer of metal oxide.

1-2. Pretreatment (Samples 1, 5 to 12, 17, 19, and 21)

The base material was introduced into a UV/Ozone Surface Processor (PL21-200 (S), manufactured by Sen Engineering Co., Ltd.), and UV ozone treatment was performed for a predetermined time.

(Sample 2)

The base material was introduced into a plasma CVD device (PBII-C600, manufactured by Kurita Manufacturing Co., Ltd.) and subjected to argon sputtering treatment for a predetermined time under the condition of a vacuum degree of about 1 Pa. Subsequently, oxygen was introduced into the device to perform oxygen plasma treatment.

(Sample 3 and Sample 22)

The base material was immersed in an aqueous sodium hydroxide solution for a predetermined time, and then rinsed thoroughly with ion-exchanged water.

(Sample 4)

The base material was immersed in dilute sulfuric acid for a predetermined time, and then rinsed thoroughly with ion-exchanged water.

(Sample 13)

The base material was scrubbed with an abrasive made up of cerium oxide, and rinsed thoroughly with ion-exchanged water.

(Sample 14)

The base material was scrubbed with a weak alkaline abrasive (product name: Kiraria, manufactured by TOTO), and rinsed thoroughly with ion-exchanged water.

(Sample 18)

The base material was polished with a diamond paste abrasive (particle size 1 μm), and rinsed thoroughly with ion-exchanged water.

(Samples 15, 16 and 20)

The base material was not subjected to pretreatment.

1-3. Formation of the Layer of Organic Compound (Samples 1 to 5 and 8 to 16, 18, 19, 21, and 22)

As a treatment agent for forming a layer of organic compound, a solution of octadecylphosphonic acid (manufactured by Tokyo Chemical Industry Co., Ltd., product code 00371) dissolved in ethanol (manufactured by FUJIFILM Wako Pure Chemical Corporation, Wako 1st Grade) was used. The base material was immersed in the treatment agent for a predetermined time, and washed with ethanol. The immersion time was 1 minute or longer for samples 1 to 5 and 8 to 16, 19, 21, and 22, and 10 seconds or shorter for sample 18. Then, it was dried in a drier at 120° C. for 10 minutes to form a layer of organic compound on the surface of the base material.

(Sample 6)

As a treatment agent for forming a layer of organic compound, a solution of dodecylphosphonic acid (manufactured by Tokyo Chemical Industry Co., Ltd., product code D4809) dissolved in ethanol was used. The immersion time was 1 minute or longer. Then, it was dried in a drier at 120° C. for 10 minutes to form a layer of organic compound on the surface of the base material.

(Sample 7)

As a treatment agent for forming a layer of organic compound, a solution of octadecylphosphonic acid and phenylphosphonic acid (manufactured by Tokyo Chemical Industry Co., Ltd., product code P0204) dissolved in ethanol so as to have a weight ratio of 1:1 was used. The immersion time was 1 minute or longer. Then, it was dried in a drier at 120° C. for 10 minutes to form a layer of organic compound on the surface of the base material.

(Sample 17)

As a treatment agent for forming a layer of organic compound of hydrocarbon groups containing fluorine atoms, a solution of (1H,1H,2H,2H-heptadecafluorodecyl) phosphonic acid (manufactured by Tokyo Chemical Industry Co., Ltd., product code H1459) dissolved in ethanol was used. The immersion time was 1 minute or longer. Then, it was dried at 120° C. for 10 minutes in a dryer to form a layer of organic compound containing fluorine atoms on the surface of the base material.

(Sample 20)

An layer of organic compound was not formed.

Table 1 presents a summary of the prepared samples.

TABLE 1

Details of Samples

| | Base Material | | | | |
|---|---|---|---|---|---|
| | Lower Layer | Middle Layer | Surface Layer | Pretreatment | Layer of Organic Compound |
| Sample 1 | Brass | Ni Plating | Cr Plating | UV Ozone Treatment | Octadecylphosphonic Acid |
| Sample 2 | Brass | Ni Plating | Cr Plating | Ar, $O_2$ Plasma Treatment | Octadecylphosphonic Acid |
| Sample 3 | Brass | Ni Plating | Cr Plating | NaOHaq Immersion | Octadecylphosphonic Acid |
| Sample 4 | Brass | Ni Plating | Cr Plating | Dilute Sulfuric Acid Immersion | Octadecylphosphonic Acid |
| Sample 5 | Brass | Ni Plating | Cr Plating | UV Ozone Treatment | Octadecylphosphonic Acid |
| Sample 6 | Brass | Ni Plating | Cr Plating | UV Ozone Treatment | Dodecylphosphonic Acid |
| Sample 7 | Brass | Ni Plating | Cr Plating | UV Ozone Treatment | Octadecylphosphonic Acid, Phenylphosphonic Acid |
| Sample 8 | Brass | Ni, Cr Plating | Titanium Nitride | UV Ozone Treatment | Octadecylphosphonic Acid |
| Sample 9 | Brass | Ni, Cr Plating | Titanium Nitride | UV Ozone Treatment | Octadecylphosphonic Acid |
| Sample 10 | Brass | Ni, Cr Plating | Zirconium Carbonitride | UV Ozone Treatment | Octadecylphosphonic Acid |
| Sample 11 | | Stainless Steel | | UV Ozone Treatment | Octadecylphosphonic Acid |
| Sample 12 | Brass | Ni Plating | Cr Plating | UV Ozone Treatment | Octadecylphosphonic Acid |
| Sample 13 | Brass | Ni Plating | Cr Plating | Abrasion with CeO2 | Octadecylphosphonic Acid |
| Sample 14 | Brass | Ni Plating | Cr Plating | Abrasion with Weak Alkaline Abrasive | Octadecylphosphonic Acid |
| Sample 15 | Brass | Ni, Cr Plating | Titanium Carbonitride | None | Octadecylphosphonic Acid |
| Sample 16 | Brass | Ni Plating | Cr Plating | None | Octadecylphosphonic Acid |
| Sample 17 | Brass | Ni Plating | Cr Plating | UV Ozone Treatment | Heptadecafluorodecylphosphonic Acid |
| Sample 18 | Brass | Ni Plating | Cr Plating | Abrasion with Diamond Paste Abrasive | Octadecylphosphonic Acid |
| Sample 19 | | Brass | | UV Ozone Treatment | Octadecylphosphonic Acid |
| Sample 20 | Brass | Ni Plating | Cr Plating | None | None |
| Sample 21 | | Aluminum | | UV Ozone Treatment | Octadecylphosphonic Acid |
| Sample 22 | Brass | Ni Plating | Cr Plating | NaOHaq Immersion | Octadecylphosphonic Acid |

2. Analysis and Evaluation Methods

The following analysis and evaluation were carried out for each of the samples prepared above. Sample 22 was cut into a size of about 10 mm×about 10 mm, which was used as a measurement sample. The measurement sample was cut out from the side surface of the spout, a portion having a relatively large radius of curvature. At the time of cutting, the portion to be analyzed and evaluated was covered with a film to prevent surface damage.

2-1. Measurement of Water Droplet Contact Angle

Before the measurement, each sample was scrubbed with a urethane sponge using a neutral detergent, and rinsed thoroughly with ultrapure water. A contact angle meter (model number: SDMs-401, manufactured by Kyowa Interface Science Co., Ltd.) was used for measuring the water droplet contact angle of each sample. Ultrapure water was used as the water for measurement, and the size of water droplet to be dropped was 2 μl. The contact angle was a so-called static contact angle, which was set to the value one second after the water was dropped, and the average value measured at five different sites was obtained. However, when an abnormal value appeared for any of the five sites, the average value was calculated by excluding the abnormal value. Table 2 presents the measurement results as the water contact angle: initial.

2-2. Removability of Scale Stains

On the surface of each sample, 20 μl of tap water was dropped and left for 24 hours to form scales on the sample surface. The sample having scales formed thereon was evaluated by the following procedure.

(i) a dry cloth was used to allow the sample to slide back and forth 10 times while applying a light load (50 gf/cm$^2$) to the surface of the sample.

(ii) a dry cloth was used to allow the sample to slide back and forth 10 times while applying a heavy load (100 gf/cm$^2$) to the surface of the sample.

Table 1 summarizes those that could be removed in the step (i) as "◎", those that could be removed in the step (ii) as "○", and those that could not be removed as "x."

Note that whether or not scales could be removed was visually determined whether or not the scales remained on the surface of the sample after the surface of the sample was washed with running water, and the water was removed with an air duster. Table 2 presents the evaluation results as the scale removability: initial.

2-3. Water Resistance Test

The surface of each sample was immersed in warm water at 70° C. for a predetermined time, and then the surface of the sample was washed with running water, and the water was removed with an air duster. The removability of scale stains was evaluated for each sample after the water resistance test. Those that could be removed by the method (ii) of 2-2 after the immersion time of 2 hours were marked with "○," and those that could not be removed were marked with "x." Furthermore, those that could be removed by the method (ii) of 2-2 after the immersion time of 48 hours were marked with "○ to ◎," and those that could be removed by the method of (ii) after the immersion time of 120 hours were marked with "◎." Table 2 presents the evaluation results after the scale removability and water resistance tests.

2-4. Removability of Sebum Stains

The sebum stain solution presented in Table 3 was thinly applied to the glass surface with a rag. The sebum stain solution on the glass was copied onto a urethane sponge (made by 3M) cut into 1 $cm^3$ and stamped on the sample surface to attach the sebum stains.

(i) a damp cloth was used to allow the sample to slide back and forth 5 times while applying a light load (50 $gf/cm^2$) to the surface of the sample.

Those that could be removed in the step (i) were marked with "○," and those that could not be removed in the step (i) were marked with "x." Note that whether or not sebum stains could be removed was visually determined. Table 2 presents the evaluation results as sebum stain removability: initial.

2-5. Wear Resistance Test

A melamine sponge was used to allow the surface of each sample to slide back and forth 3000 times while applying a load (200 $gf/cm^2$) to the sample surface with the melamine sponge moistened with water. After sliding, the surface of the sample was washed with running water, and the water was removed with an air duster. For each sample after the wear test, the water droplet contact angle measurement and the removability of sebum stains were evaluated. Table 2 presents the evaluation results as the water contact angle: after the wear resistance test and the sebum stain removability: after the wear resistance test.

2-6. Measurement of Each Atomic Concentration

Each atomic concentration on the surface of various samples was determined by X-ray photoelectron spectroscopy (XPS). Before the measurement, it was scrubbed with a urethane sponge using a neutral detergent, and then rinsed thoroughly with ultrapure water. As the XPS device, PHI Quantera II (manufactured by ULVAC-PHI, Inc.) was used. The spectrum was obtained by wide scan analysis under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (280 eV), and scanning range (15.5 to 1100 eV). The concentration of the detected atoms was calculated from the obtained spectrum by using data analysis software PHI MultiPak (manufactured by ULVAC-PHI, Inc.). The obtained spectrum was subjected to charge correction with the C1s peak set to 284.5 eV. Then, the Shirley method was carried out on the measured peaks based on the electron orbits of the atoms to remove the background, and thereafter the peak area intensity was calculated. Analysis processing was performed that divides by the relative sensitive factors (RSF) for XPS preset in the data analysis software. In this way, the phosphorus atom concentration (hereinafter $C_P$), the oxygen atom concentration (hereinafter $C_O$), the metal atom concentration (hereinafter $C_M$), and the carbon atom concentration (hereinafter $C_C$) were calculated. For the concentration calculation, the peak areas used were P2p peak for phosphorus, C1s peak for carbon, O1s peak for oxygen, Cr2p3 peak for chromium, Ti2p peak for titanium, and Zr3d peak for zirconium. The value of each concentration was the average value measured at three different sites. However, when an abnormal value appeared for any of the three sites, the average value was calculated by excluding the abnormal value. Table 2 presents the concentrations of the obtained phosphorus atom, oxygen atom, metal atom, and carbon atom.

2-7. Calculation of $R_{O/M}$

The $C_O$ and $C_M$ obtained by XPS analysis were used to calculate $R_{O/M}$ by the formula (A). Table 2 presents the values of Rum obtained.

$$R_{O/M}=C_O/C_M \quad \text{formula (A)}$$

2-9. C1s Spectrum

Figure 4:
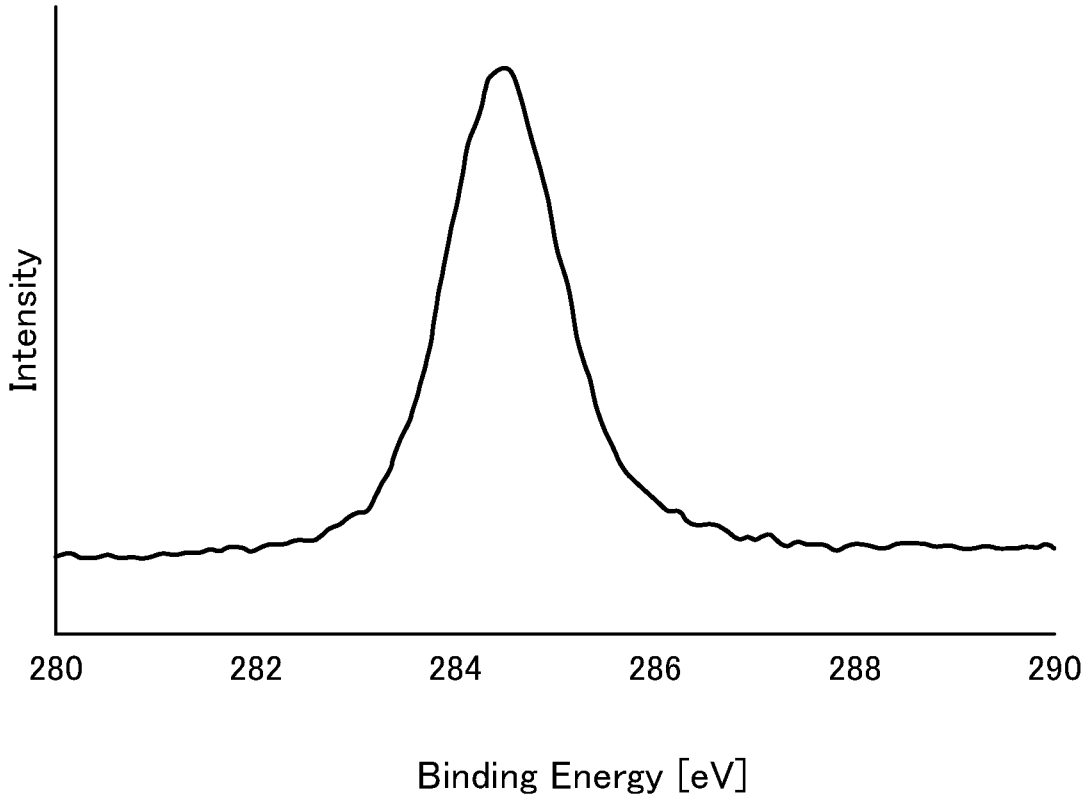
FIG. 4 illustrates the C1s spectrum obtained by XPS analysis of sample 3.

Before the measurement, the sponge was allowed to slide and washed with a neutral detergent, and then rinsed thoroughly with ultrapure water. As the XPS device, PHI Quantera II (manufactured by ULVAC-PHI, Inc.) was used. The C1s spectrum was obtained by measurement under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (112 eV), and scanning range (278 to 298 eV). FIG. 4 illustrates the C1s spectrum of sample 3.

2-10. P2p Spectrum

Figure 5:
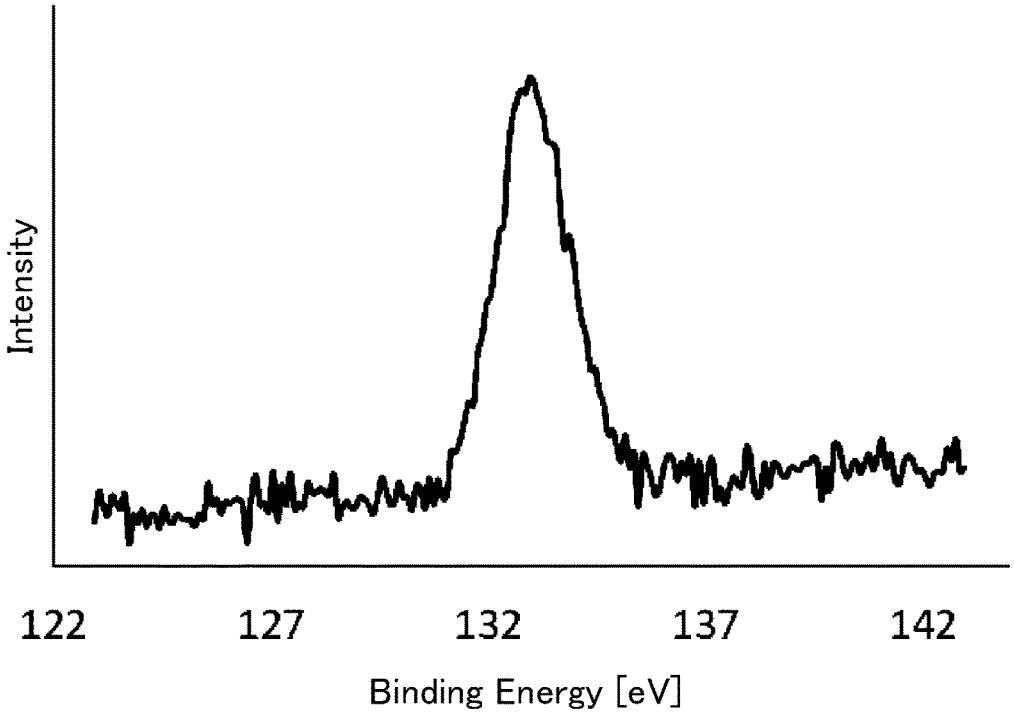
FIG. 5 illustrates a P2p spectrum obtained by XPS analysis of sample 3.

Before the measurement, the sponge was allowed to slide and washed with a neutral detergent, and then rinsed thoroughly with ultrapure water. As the XPS device, PHI Quantera II (manufactured by ULVAC-PHI, Inc.) was used. The P2p spectrum was obtained by measurement under the conditions of X-ray condition (monochromatic AlKα ray, 25 W, 15 kv), analysis area: 100 μmφ, charge neutralizer setting (Emission: 20 μA), ion gun setting (Emission: 7.00 mA), photoelectron take-off angle (45°), Time per step (50 ms), Sweep (10 times), Pass energy (112 eV), and scanning range (122 to 142 eV). FIG. 5 illustrates the P2p spectrum of sample 3.

2-11. Confirmation of Metal Elements in Oxide Layer

For samples 1 to 18 and 22, it was confirmed by X-ray photoelectron spectroscopy (XPS) that the metal element was in an oxide state. Before the measurement, the sponge was allowed to slide and washed with a neutral detergent, and then rinsed thoroughly with ultrapure water. As the XPS device, PHI Quantera II (manufactured by ULVAC-PHI, Inc.) can be used. The spectrum of each metal element peak was obtained by narrow scan analysis under the conditions of X-ray condition (monochromatic AlKα ray, 25 W, 15 kv), analysis area: 100 μmφ, charge neutralizer setting (Emission: 20 pA), ion gun setting (Emission: 7.00 mA), photoelectron take-off angle (45°), Time per step (50 ms), Sweep (10 times), and Pass energy (112 eV). It was confirmed that the range of narrow scan analysis was the range of Cr2p3 peak for samples 1 to 7, 11 to 14, 16 to 18, and 22, the range of Ti2p peak for samples 8, 9 and 15, and the range of Zr3d peak for sample 10, the background of the obtained peaks was removed by the Shirley method, and all the samples contained metal elements in an oxidized state.

2-12. Evaluation 1 of Thickness of Layer of Organic Compound

Figure 6:
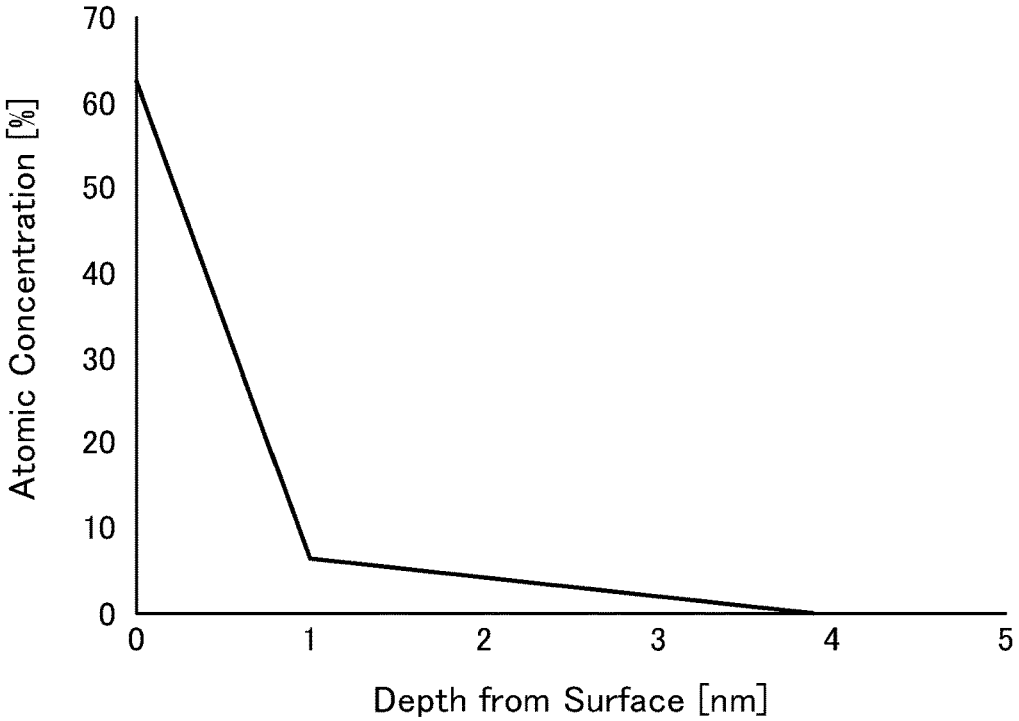
FIG. 6 illustrates the depth profile of the carbon atom concentration obtained by XPS analysis of sample 3 using argon ion beam sputtering.

The thickness of the layer of organic compound was evaluated by XPS depth profile measurement. The XPS measurement was performed under the same conditions as 2-9. The argon ion beam sputtering conditions were such that the sputtering rate was 1 nm/min. This sputtering rate was used to convert the sputtering time into the distance from the sample surface in the Z direction. The measurement point with a sputtering time of 0 minutes was set to the surface (0 nm), and the measurement was performed until the depth was 20 nm from the surface. The carbon atom concentration in the base material was defined as the carbon concentration at a depth of about 20 nm from the surface. The carbon atom concentration was measured in the depth direction from the sample surface, and the maximum depth at which the carbon atom concentration was higher by 1 at % or more than the carbon atom concentration of the base material was evaluated as the thickness of the layer of organic compound. For all the samples, the thickness of the layer of organic compound was 5 nm or less. As a measurement example, FIG. 6 illustrates an XPS depth profile of sample 3.

2-13. Evaluation 2 of Thickness of Layer of Organic Compound

The thickness of the layer of organic compound was evaluated by XPS depth profile measurement using an argon gas cluster ion beam (Ar-GCIB). The XPS measurement was performed under the same conditions as 2-9. The argon sputtering conditions were such that ion source: Ar2500+, acceleration voltage: 2.5 kV, sample voltage: 100 nA, sputtering area: 2 mm×2 mm, charge neutralization condition 1.1 V, and ion gun: 7 V. The sputtering rate used was a value (0.032 nm/min) obtained by performing Ar-GCIB measurement on octadecyltrimethoxysilane (1.6 nm) formed on a silicon wafer whose film thickness had been measured in advance by X-ray reflectometry (XRR) as a standard sample.

The film thickness of the standard sample is measured by X-ray reflectometry (XRR) (X'pert pro manufactured by PANalytical Ltd.) to obtain a (X-ray) reflectivity profile. For the obtained (X-ray) reflectivity profile, analysis software (X'pert Reflectivity) was used to perform fitting to the multilayer film model of Parratt and the roughness formula of Nevot-Crosse, to thereby obtain the film thickness of the standard sample. Next, Ar-GCIB measurement was performed on the standard sample to obtain the sputtering rate (0.029 nm/min) of the layer of organic compound. For the film thickness of the layer of organic compound on the sample (layer of organic compound), the obtained sputtering rate was used to convert the sputtering time into the distance from the sample surface in the Z direction. The XRR measurement and analysis conditions and the Ar-GCIB measurement conditions are as follows.

(XRR Measurement Conditions)

Device: X'pert pro (PANalytical Ltd.)
X-ray source: CuKα
Tube voltage: 45 kV
Tube current: 40 mA
Incident Beam Optics
Divergence slit: ¼°
Mask: 10 mm
Solar slit: 0.04 rad
Anti-scattering slit: 1°
Diffracted Beam Optics
Anti-scattering slit: 5.5 mm
Solar slit: 0.04 rad
X-ray detector: X'Celerator
Pre Fix Module: Parallel plate Collimator 0.27
Incident Beam Optics: Beam Attenuator Type Non
Scan mode: Omega
Incident angle: 0.105-2.935

(XRR Analysis Conditions)

The following initial conditions are set.
Layer sub: Diamond Si (2.4623 g/cm$^3$)
Layer 1: Density Only $SiO_2$ (2.7633 g/cm$^3$)
Layer 2 Density Only C (1.6941 g/cm$^3$)

(Ar-GCIB Measurement Conditions)

Device: PHI Quantera II (manufactured by ULVAC-PHI, Inc.)
X-ray conditions: monochromatic AlKα ray, 25 W, 15 kv
Analysis area: 100 mφ
Charge neutralizer setting: 20 μA
Ion gun setting: 7.00 mA
Photoelectron take-off angle: 45°
Time per step: 50 ms
Sweep: 10 times
Pass energy: 112 eV
Measurement interval: 10 min
Spatter-setting: 2.5 kV
Binding energy: C1s (278 to 298 eV)

Figure 7:
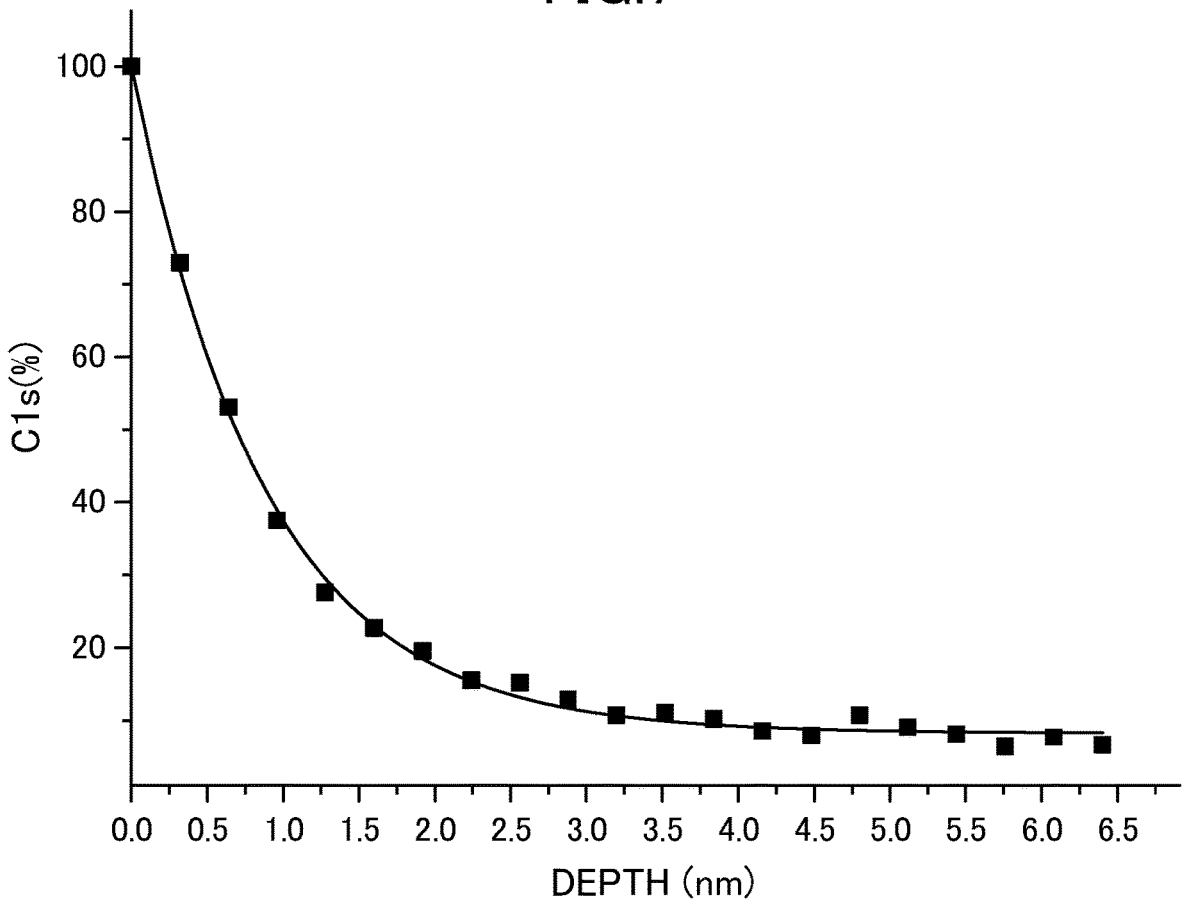
FIG. 7 illustrates the depth profile of carbon atom concentration obtained by XPS analysis using an argon gas cluster ion beam (Ar-GCIB) of sample 3.

This sputtering rate was used to convert the sputtering time into the distance from the sample surface in the Z direction. The carbon atom concentration was measured in the depth direction from the surface of the sample by measuring up to a sputtering time of 100 minutes with the surface (0 nm) as the measurement point with a sputtering time of 0 minutes. A depth profile plotted for each depth was drawn with the horizontal axis representing the depth (nm) converted from the sputtering rate and the vertical axis representing the carbon (C1s) concentration on the surface as 100%, and the film thickness of the layer of organic compound was calculated from the horizontal axis of the inflection point of the depth profile curve. The film thickness was the average value measured at three different sites. However, when an abnormal value appeared for any of the three sites, the average value was calculated by excluding the abnormal value. Table 2 presents the results. As a measurement example, FIG. 7 illustrates an Ar-GCIB depth profile of XPS of sample 3. The film thickness obtained from the inflection point of the depth profile was 2.0 nm.

2-14. Water Resistance Test 2 Appearance Evaluation

Samples 1 to 22 were immersed in warm water at 90° C. for 1 hour, and then the samples was taken out, and the warm water adhering to the sample was immediately removed with an air duster. The sample from which warm water had been removed was left indoors to cool to room temperature, and then the surface of the sample was visually observed. Those for which an abnormality was observed after being immersed in warm water were marked with "x." In addition, those for which no abnormality was observed after being immersed in warm water were marked with "0." Table 2 presents the results.

TABLE 2

| Sample No. | Example/ Comparative Example | Thickness of Layer of Organic Compound (nm) | Metal Element | XPS Surface Atomic Concentration: Phosphorus ($C_P$) | Oxygen ($C_O$) | Metal ($C_M$) | $R_{O/M}$ | Carbon ($C_C$) |
|---|---|---|---|---|---|---|---|---|
| 1 | Example | — | Cr | 2.0 at % | 29 at % | 8 at % | 3.5 | 61 at % |
| 2 | Example | — | Cr | 2.5 at % | 31 at % | 9 at % | 3.3 | 57 at % |
| 3 | Example | 2.0 | Cr | 2.3 at % | 24 at % | 9 at % | 2.8 | 64 at % |
| 4 | Example | — | Cr | 2.4 at % | 29 at % | 12 at % | 2.5 | 56 at % |
| 5 | Example | 1.1 | Cr | 1.5 at % | 35 at % | 14 at % | 2.5 | 49 at % |
| 6 | Example | 1.5 | Cr | 2.7 at % | 41 at % | 13 at % | 3.2 | 43 at % |
| 7 | Example | 1.3 | Cr | 3.1 at % | 34 at % | 12 at % | 2.8 | 50 at % |
| 8 | Example | — | Ti | 2.7 at % | 25 at % | 7 at % | 3.5 | 61 at % |
| 9 | Example | — | Ti | 2.0 at % | 22 at % | 12 at % | 1.9 | 47 at % |
| 10 | Example | 1.8 | Zr | 2.7 at % | 27 at % | 13 at % | 2.1 | 53 at % |
| 11 | Example | — | Cr, Fe | 5.9 at % | 40 at % | 9 at % | 4.4 | 46 at % |
| 12 | Example | — | Cr | 1.8 at % | 28 at % | 15 at % | 1.9 | 55 at % |
| 13 | Example | — | Cr | 2.2 at % | 24 at % | 14 at % | 1.7 | 59 at % |
| 14 | Example | — | Cr | 1.9 at % | 23 at % | 17 at % | 1.4 | 58 at % |
| 15 | Example | — | Ti | 1.3 at % | 18 at % | 11 at % | 1.7 | 47 at % |
| 16 | Example | — | Cr | 1.2 at % | 33 at % | 11 at % | 2.9 | 54 at % |
| 17 | Comparative Example | 1.1 | Cr | 1.3 at % | 30 at % | 12 at % | 2.5 | 56 at % |
| 18 | Comparative Example | — | Cr | 0.7 at % | 34 at % | 25 at % | 1.4 | 40 at % |
| 19 | Comparative Example | — | Cu, Zn | 2.0 at % | 18 at % | — | — | 51 at % |
| 20 | Comparative Example | — | Cr | — | — | — | — | |
| 21 | Comparative Example | — | Al | 3.2 at % | 34 at % | 19 at % | 1.8 | 44 at % |
| 22 | Example | — | Cr | 1.5 at % | 32 at % | 14 at % | 2.3 | 52 at % |

| Sample No. | Example/ Comparative Example | Scale Removability: Initial | Scale Removability: After Water Resistance Test | Sebum Stain Removability: Initial | Sebum Stain Removability: After Wear Resistance Test | Water Contact Angle: Initial | Water Contact Angle: After Wear Resistance Test | Appearance: After Water Resistance Test |
|---|---|---|---|---|---|---|---|---|
| 1 | Example | ◎ | ◎ | ○ | ○ | 107° | 101° | ○ |
| 2 | Example | ◎ | ◎ | ○ | ○ | 107° | 100° | ○ |
| 3 | Example | ◎ | ◎ | ○ | ○ | 108° | 102° | ○ |
| 4 | Example | ◎ | ◎ | ○ | ○ | 108° | 98° | ○ |
| 5 | Example | ◎ | ◎ | ○ | ○ | 106° | 100° | ○ |
| 6 | Example | ◎ | ◎ | — | — | 106° | — | ○ |
| 7 | Example | ◎ | ◎ | — | — | 102° | — | ○ |
| 8 | Example | ◎ | ◎ | ○ | ○ | 105° | 101° | ○ |
| 9 | Example | ◎ | ◎ | ○ | ○ | 106° | 104° | ○ |
| 10 | Example | ◎ | ◎ | ○ | ○ | 105° | 105° | ○ |
| 11 | Example | ◎ | ◎ | — | — | 106° | — | ○ |
| 12 | Example | ◎ | ◎ | ○ | ○ | 108° | 102° | ○ |
| 13 | Example | ◎ | ◎ | ○ | X | 108° | 88° | ○ |
| 14 | Example | ◎ | ○ | ○ | X | 108° | 84° | ○ |
| 15 | Example | ○ | ○ | ○ | X | 101° | 89° | ○ |
| 16 | Example | ○ | ○ | ○ | X | 105° | 81° | ○ |
| 17 | Comparative Example | ○ | X | ○ | X | 115° | 79° | ○ |
| 18 | Comparative Example | X | — | — | — | 92° | — | — |
| 19 | Comparative Example | X | — | ○ | X | 106° | 73° | — |
| 20 | Comparative Example | X | — | — | X | 75° | — | — |
| 21 | Comparative Example | ◎ | ○ | — | — | 108° | — | X |
| 22 | Example | ◎ | ◎ | — | — | 105° | — | ○ |

TABLE 3

| | |
|---|---|
| Artificial Fingerprint Liquid (Manufactured by ISEKYU) * | 5 wt % |
| Fatty Acid Sodium | 0.5 wt % |
| Ethanol | 90 wt % |
| Ion-Exchanged Water | 4.5 wt % |

* A composition in accordance with JIS K2246 (2007). An aqueous solution containing sodium chloride, lactic acid, and urea.

(Confirmation of R—X)

To confirm R—X, TOF-SIMS and ESI-TOF-MS/MS were used.

(Confirmation of R—X by TOF-SIMS)

The measurement conditions of TOF-SIMS were such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16.

For samples 1 to 5, 7 to 16, 18, 19, 21, and 22 using octadecylphosphonic acid ($C_{18}H_{39}O_3P$) as the treatment agent, it was confirmed that peaks were detected at m/z=335 ($C_{18}H_{40}O_3P^+$) in the positive mode and at m/z=333 ($C_{18}H_{38}O_3P^-$) in the negative mode.

For sample 6 using dodecylphosphonic acid ($C_{12}H_{27}O_3P$) as the treatment agent, it was confirmed that peaks were detected at m/z=251 ($C_{12}H_{28}O_3P^+$) in the positive mode and at m/z=249 ($C_{12}H_{26}O_3P^-$) in the negative mode.

For sample 7 using octadecylphosphonic acid ($C_{18}H_{39}O_3P$) and phenylphosphonic acid ($C_6H_7O_3P$) as the treatment agent so as to have a weight ratio of 1:1, it was confirmed that the same peak as in sample 1 was detected for octadecylphosphonic acid. For phenylphosphonic acid, it was confirmed that peaks were detected at m/z=159 ($C_6H_8O_3P^+$) in the positive mode and at m/z=157 ($C_6H_6O_3P^-$) in the negative mode.

(ESI-TOF-MS/MS)

For ESI-TOF-MS/MS measurement, Triple TOF 4600 (manufactured by SCIEX) was used. In the measurement, the cutout base material was immersed in ethanol, and the treatment agents used for forming the layer of organic compound were extracted with unnecessary components filtered, transferred to a vial (about 1 mL), and then measured. MS/MS measurement was performed under the measurement conditions that ion source: ESI/Duo Spray Ion Source, ion mode (Positive/Negative), IS voltage (4500/−4500 V), source temperature (600° C.), DP (100 V), and CE (40 V/−40 V), for example.

Figure 8:
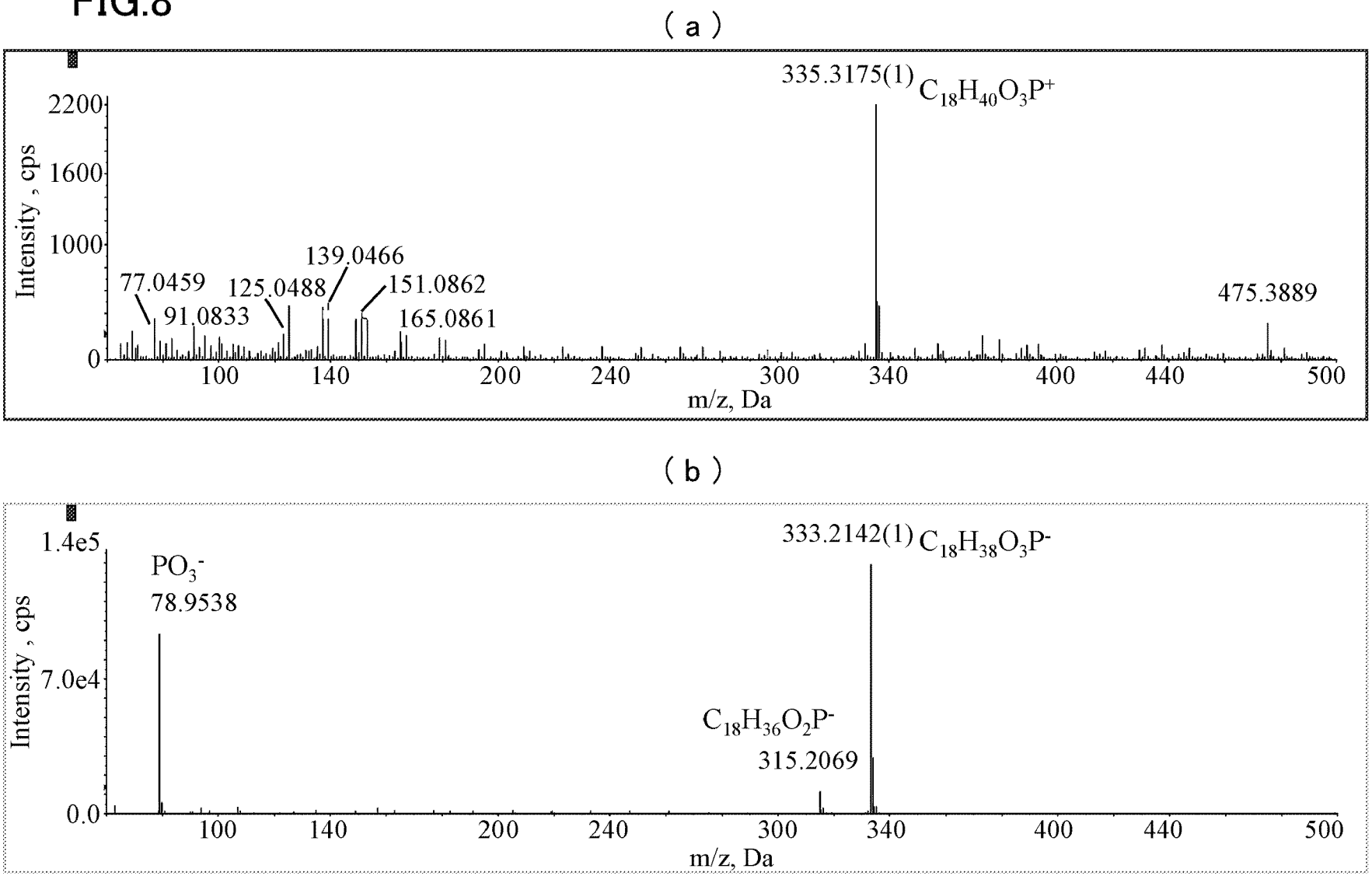
FIG. 8 illustrates mass spectra ((a) positive, (b) negative) obtained by Q-TOF-MS/MS analysis of sample 3.

For samples 1 to 5, 7 to 16, 18, 19, 21, and 22 using octadecylphosphonic acid ($C_{18}H_{39}O_3P$) as the treatment agent, it was confirmed that peaks were detected at m/z=335.317 ($C_{18}H_{40}O_3P^+$) in the positive mode of the MS/MS analysis, and at m/z=333.214 ($C_{18}H_{38}O_3P^-$) and m/z=78.952 (fragment ion $PO_3^-$ of $C_{18}H_{38}O_3P^-$) in the negative mode. FIG. 8 illustrates the spectrum obtained by Q-TOF-MS/MS analysis of sample 3.

For sample 6 using dodecylphosphonic acid ($C_{12}H_{27}O_3P$) as the treatment agent, it was confirmed that peaks were detected at m/z=251.210 ($C_{12}H_{27}O_3P^+$) in the positive mode of the MS/MS analysis, and at m/z=249.138 ($C_{12}H_{26}O_{3P}^-$) and m/z=78.954 (fragment ion $PO_3^-$ of $C_{12}H_{27}O_3P^-$) in the negative mode.

For sample 7 using octadecylphosphonic acid ($C_{18}H_{39}O_3P$) and phenylphosphonic acid ($C_6H_7O_3P$) as the treatment agent so as to have a weight ratio of 1:1, it was confirmed that the same peak as in sample 1 was detected for octadecylphosphonic acid. For phenylphosphonic acid, it was confirmed that peaks were detected at m/z=159.036 ($C_6H_8O_3P^+$) in the positive mode of the MS/MS analysis and at m/z=156.985 ($C_6H_6O_3P^-$) in the negative mode, and moreover that a peak was detected at m/z=79.061 (fragment ions of $C_6H_6^{3+}$) in the positive mode of the MS/MS analysis.

(Confirmation that One End of R, which is an End that is not a Bonding End with X, is Made Up of C and H)

Surface enhanced Raman spectroscopy was used to confirm that one end of R was made up of C and H and that R was a hydrocarbon made up of C and H.

(Confirmation by Surface Enhanced Raman)

As the surface enhanced Raman spectroscopy analyzer, a transmission-type plasmonic sensor (for surface enhanced Raman spectroscopy) described in Japanese Patent No. 6179905 was used as the surface enhanced Raman sensor, and NanoFinder 30 (Tokyo Instruments, Inc.) was used as a confocal microscope Raman spectrometer. The measurement was performed with a transmission-type surface enhanced Raman sensor placed on the cutout surface of the base material. The measurement conditions were such that Nd: YAG laser (532 nm, 1.2 mW), scan time (10 seconds), grating (800 Grooves/mm), and pinhole size (100 μm).

For samples 1 to 5, 8 to 16, 18, 19, 21, and 22 using octadecylphosphonic acid ($C_{18}H_{39}O_3P$) as the treatment agent, and sample 6 using dodecylphosphonic acid ($C_{12}H_{27}O_3P$) as the treatment agent, the detection of Raman shift 2930 $cm^{-1}$ confirmed that one end of R was a methyl group.

In addition, the detection of Raman shift 2850 and 2920 $cm^{-1}$ confirmed that R was a hydrocarbon made up of C and H.

(Confirmation of M-O—P Bond)

To confirm the M-O—P bond, TOF-SIMS and surface enhanced Raman spectroscopy were used.

(Confirmation of M-O—P by TOF-SIMS)

Figure 9:
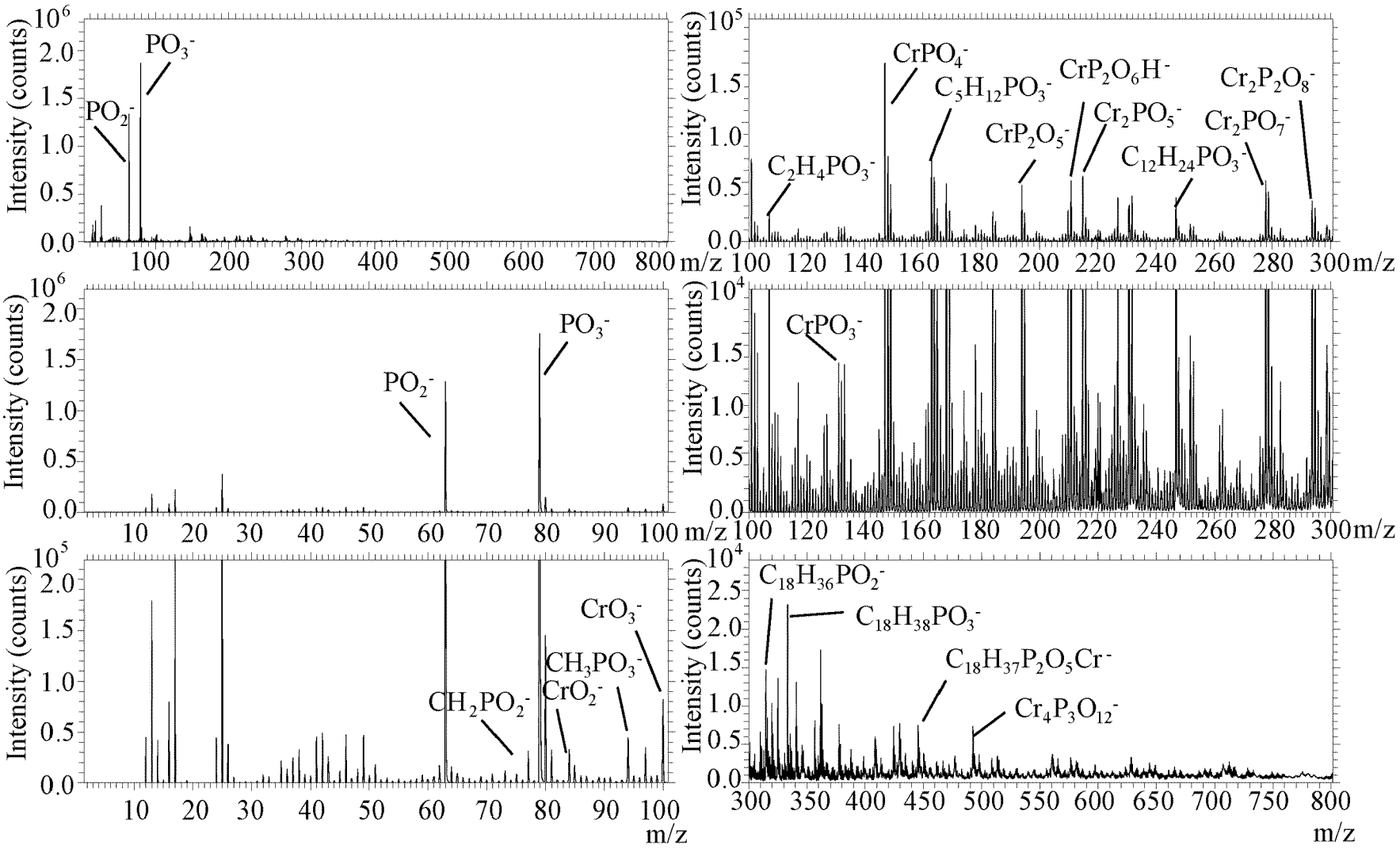
FIG. 9 illustrates a secondary ion mass spectrum (negative) obtained by TOF-SIMS analysis of sample 3.

The measurement conditions of TOF-SIMS were such that primary ions to be emitted: $^{209}Bi_3^{++}$, primary ion acceleration voltage 25 kV, pulse width 10.5 or 7.8 ns, bunching: on, electrification neutralization: off, post acceleration 9.5 kV, measurement range (area): about 500×500 $\mu m^2$, secondary ions to be detected: Positive, Negative, Cycle Time: 110 μs, scan count 16. As a measurement result, a secondary ion mass spectrum (m/z) derived from R—X is obtained. Confirmation was made by obtaining, as results of the measurement, a secondary ion mass spectrum derived from a combination of R—X and the metal oxide element M (R—X-M) and a secondary ion mass spectrum derived from M-O—P (m/z). FIG. 9 illustrates the secondary ion mass spectrum in the negative mode obtained by TOF-SIMS analysis of sample 3.

For samples 1 to 5, 11 to 14, 16, and 22 containing Cr in the layer of metal oxide and using octadecylphosphonic acid ($C_{18}H_{39}O_3P$) as the treatment agent, it was confirmed that any of the ions with m/z=417 ($C_{18}H_{38}PO_5Cr^-$) and m/z=447 ($C_{18}H_{37}P_2O_5Cr^-$) (R—X-M) was detected as well as the ion with 146 ($PO_4Cr^-$) (O-M-O—P) in the negative mode.

For samples 8, 9, and 15 containing Ti in the layer of metal oxide and using octadecylphosphonic acid ($C_{18}H_{39}O_3P$) as the treatment agent, it was confirmed that any of the ions with m/z=413 ($C_{18}H_{38}PO_3Ti^-$) and m/z=443 ($C_{18}H_{37}P_2O_5Ti^-$) (R—X-M) was detected as well as the ion with m/z=142 ($PO_4Ti^-$) (O-M-O—P) in the negative mode.

For sample 10 containing Zr in the layer of metal oxide and using octadecylphosphonic acid ($C_{18}H_{39}O_3P$) as the treatment agent, it was confirmed that any of the ions with m/z=456 ($C_{18}H_{38}PO_5Zr^-$) and m/z=486 ($C_{18}H_{37}P_2O_5Zr^-$)

(R—X-M) was detected as well as the ion with m/z=186 ($PO_4Zr^-$) (O-M-O—P) in the negative mode. For sample 19, the detection of the secondary ion mass spectrum derived from R—X-M and the secondary ion mass spectrum (m/z) derived from M-O—P was not confirmed.

For sample 6 using dodecylphosphonic acid ($C_{12}H_{27}O_3P$) as the treatment agent, it was confirmed that ions were detected at m/z=332 ($C_{12}H_{25}PO_5Cr^-$) (R—X-M) and at 146 ($PO_4Cr^-$) (O-M-O—P) in the negative mode.

For sample 7 using octadecylphosphonic acid ($C_{18}H_{39}O_3P$) and phenylphosphonic acid ($C_6H_7O_3P$) as the treatment agent so as to have a weight ratio of 1:1, it was confirmed that the same peak as in sample 1 was detected for octadecylphosphonic acid. For phenylphosphonic acid, it was confirmed that ions were detected at m/z=159 ($C_6H_8O_3PCr^+$) (R—X-M) in the positive mode and at m/z=146 ($PO_4Cr^-$) (O-M-O—P) in the negative mode.

(Confirmation of M-O—P by Surface Enhanced Raman)

As the surface enhanced Raman spectroscopy analyzer, a transmission-type plasmonic sensor (for surface enhanced Raman spectroscopy) described in Japanese Patent No. 6179905 was used as the surface enhanced Raman sensor, and NanoFinder 30 (Tokyo Instruments, Inc.) was used as a confocal microscope Raman spectrometer. The measurement was performed with a transmission-type surface enhanced Raman sensor placed on the cutout surface of the base material. The measurement conditions were such that Nd: YAG laser (532 nm, 1.2 mW), scan time (10 seconds), grating (800 Grooves/mm), and pinhole size (100 μm).

The signal derived from the M-O—P bond was assigned from the Raman signal in which the bond state of the M-O—P bond immobilized on the oxide layer had been estimated in advance using Material Studio as a first principle calculation software package. As the calculation conditions for the first principle calculation, structure optimization was performed with software used (CASTEP), functional (LDA/CA-PZ), cutoff (830 eV), K point (2*2*2), pseudopotential (Norm-conserving), Dedensity mixing (0.05), spin (ON), and Metal (OFF). In addition, Raman spectrum calculation was performed with software used (CASTEP), functional (LDA/CA-PZ), cutoff (830 eV), K point (1*1*1), pseudopotential (Norm-conserving), Dedensity mixing (All Bands/EDFT), spin (OFF), and Metal (OFF).

It was confirmed as follows that a signal derived from each bond state of M-O—P was detected for samples 1 to 7, 11 to 14, 16, and 22 containing chromium as the metal element of the base material.

By detecting two or more signals for the Raman shifts 377 $cm^{-1}$, 684 $cm^{-1}$, 772 $cm^{-1}$, and 1014 $cm^{-1}$, it was confirmed that the phosphonic acid obtained by first principle calculation contained a state bonded with one chromium atom (state with one M-O—P bond per phosphonic acid group: "bond 1").

By detecting two or more signals for the Raman shifts 372 $cm^{-1}$, 433 $cm^{-1}$, 567 $cm^{-1}$, 766 $cm^{-1}$, and 982 $cm^{-1}$, it was confirmed that the phosphonic acid obtained by first principle calculation contained a state bonded with two chromium atoms (state with two M-O—P bonds per phosphonic acid group: "bond 2").

By detecting two or more signals for the Raman shifts 438 $cm^{-1}$, 552 $cm^{-1}$, 932 $cm^{-1}$, and 1149 $cm^{-1}$, it was confirmed that the phosphonic acid obtained by first principle calculation contained a state bonded with three chromium atoms (state with three M-O—P bonds per phosphonic acid group: "bond 3").

Figure 10:
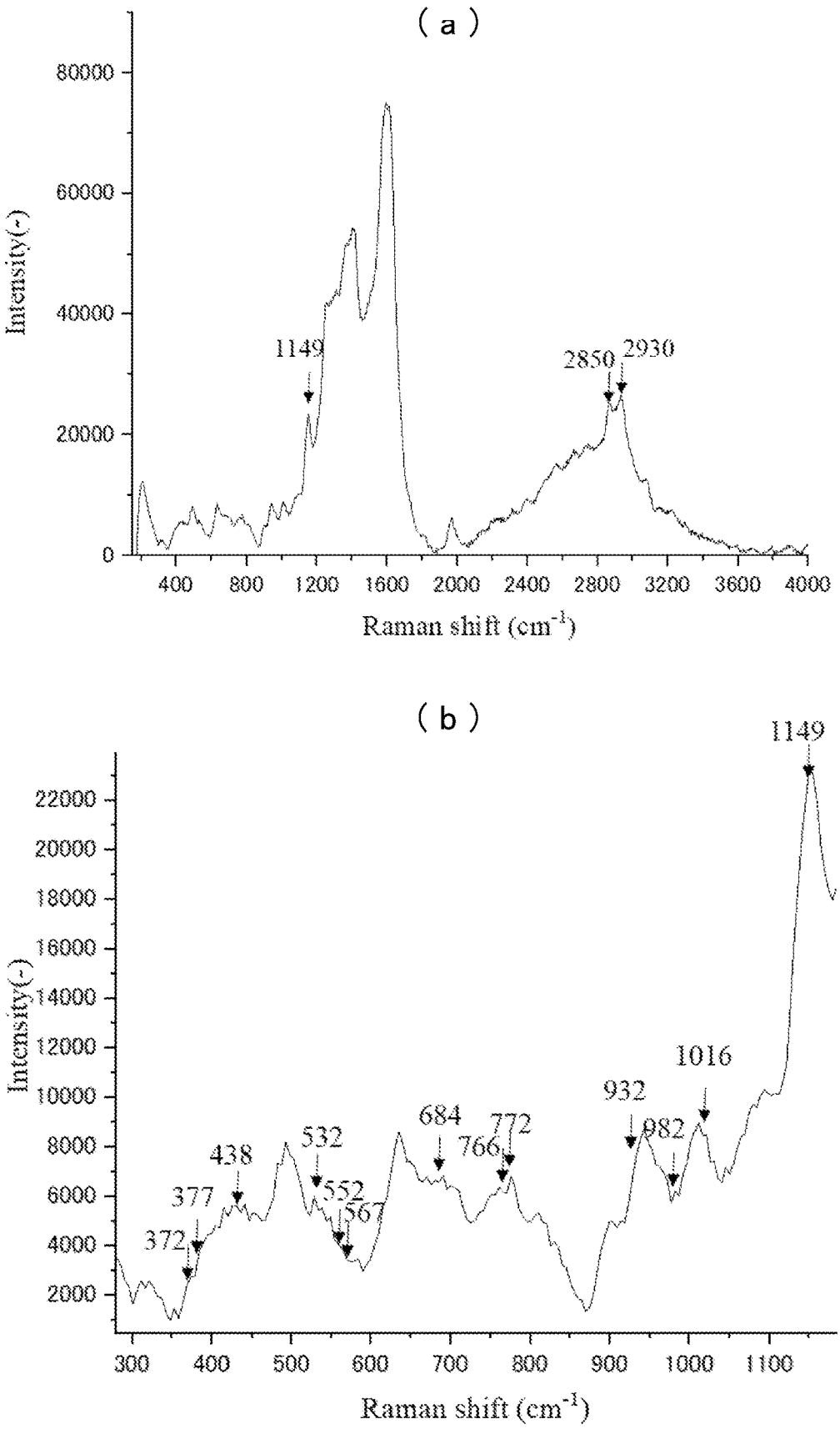
FIG. 10 illustrates Raman spectra ((a) 180 to 4000 $cm^{-1}$, (b) 280 to 1190 $cm^{-1}$) obtained by SERS Raman analysis of sample 3.

FIG. 10 illustrates a transmission-type surface enhanced Raman spectrum of sample 3. For sample 3, since signals were detected for the Raman shifts 377 $cm^{-1}$, 684 $cm^{-1}$, 772 $cm^{-1}$, 1014 $cm^{-1}$, 372 $cm^{-1}$, 433 $cm^{-1}$, 567 $cm^{-1}$, 766 $cm^{-1}$, 982 $cm^{-1}$, 438 $cm^{-1}$, 552 $cm^{-1}$, 932 $cm^{-1}$, 1149 $cm^{-1}$, it was confirmed that the phosphonic acid contained all the bonds of bond 1, bond 2, and bond 3 for the chromium atoms.

It was confirmed as follows that a signal derived from each bond state of M-O—P was detected for sample 10 containing zirconium as the metal element of the base material.

By detecting two or more signals for the Raman shifts 684 $cm^{-1}$, 770 $cm^{-1}$, 891 $cm^{-1}$, and 901 $cm^{-1}$, it was confirmed that the phosphonic acid obtained by first principle calculation contained a state bonded with one zirconium atom (state with one M-O—P bond per phosphonic acid group: "bond 1").

By detecting two or more signals for the Raman shifts 694 $cm^{-1}$, 716 $cm^{-1}$, 1272 $cm^{-1}$, 1305 $cm^{-1}$, and 1420 $cm^{-1}$, it was confirmed that the phosphonic acid obtained by first principle calculation contained a state bonded with two zirconium atoms (state with two M-O—P bonds per phosphonic acid group: "bond 2").

By detecting two or more signals for the Raman shifts 559 $cm^{-1}$, 943 $cm^{-1}$, 1006 $cm^{-1}$, and 1110 $cm^{-1}$, it was confirmed that the phosphonic acid obtained by first principle calculation contained a state bonded with three zirconium atoms (state with three M-O—P bonds per phosphonic acid group: "bond 3").

Since Raman shift signals were detected for sample 10, it was confirmed that the phosphonic acid contained all the bonds of bond 1, bond 2, and bond 3 for the zirconium atoms.

What is claimed is:

1. A sanitary equipment part comprising:

a base material having a metal element at least on a surface thereof;

a layer of metal oxide formed on the surface of the base material; and a layer of organic compound provided on the layer of metal oxide, wherein the metal element is at least one selected from the group consisting of Cr, Zr, and Ti, the layer of metal oxide contains a metal element which is at least one selected from the group consisting of Cr, Zr, and Ti and an oxygen element, and the layer of organic compound binds to the layer of metal oxide by binding the metal element (M) via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group, and a phosphorus atom concentration on a surface of the sanitary equipment part, which is calculated from a peak area of a P2p spectrum measured according to Condition 1 by X-ray photoelectron spectroscopy (XPS), is 1.0 at % or more and 10 at % or less, and a carbon atom concentration on the surface of the sanitary equipment part, which is calculated based on a peak area of a C1s spectrum measured according to Condition 1 by X-ray photoelectron spectroscopy (XPS), is 35 at % or more;

(Condition 1)

X-ray condition: monochromatic AlKα ray (output 25 W)

Photoelectron take-off angle: 45°

Analysis area: 100 μmφ

Scanning range: 15.5 to 1100 eV.

2. The sanitary equipment part according to claim 1, wherein in the layer of organic compound, one end of R, which is an end that is not a bonding end with X, is made up of C and H.

3. The sanitary equipment part according to claim 2, wherein R is a hydrocarbon group made up of C and H.

4. The sanitary equipment part according to claim 1, wherein in the layer of organic compound, X is made up of phosphonic acid.

5. The sanitary equipment part according to claim 1, wherein the layer of organic compound is free of a fluorine atom.

6. The sanitary equipment part according to claim 1, wherein the layer of organic compound is a monolayer.

7. The sanitary equipment part according to claim 6, wherein the layer of organic compound is a self-assembled monolayer.

8. The sanitary equipment part according to claim 1, wherein the phosphorus atom concentration is 1.5 at % or more.

9. The sanitary equipment part according to claim 1, wherein an oxygen atom/metal atom concentration ratio (O/M ratio) on the surface of the sanitary equipment part, which is calculated from peak areas of an O1s spectrum and a metal spectrum measured according to Condition 1 by X-ray photoelectron spectroscopy (XPS), is greater than 1.7.

10. The sanitary equipment part according to claim 9, wherein the O/M ratio is 1.8 or more.

11. The sanitary equipment part according to claim 1, wherein the sanitary equipment is used in an environment exposed to water.

12. The sanitary equipment part according to claim 1, wherein the sanitary equipment is indoor equipment.

13. The sanitary equipment part according to claim 11, wherein the sanitary equipment part is a faucet.

14. The sanitary equipment part according to claim 13, wherein the sanitary equipment part is a faucet that discharges warm water.

15. A sanitary equipment part comprising:

a base material having a metal element at least on a surface thereof;

a layer of metal oxide formed on the surface of the base material; and a layer of organic compound provided on the layer of metal oxide, wherein the metal element is at least one selected from the group consisting of Cr, Zr, and Ti, the layer of metal oxide contains a metal element which is at least one selected from the group consisting of Cr, Zr, and Ti and an oxygen element, and the layer of organic compound binds to the layer of metal oxide by binding the metal element (M) via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group, and a carbon atom concentration on the surface of the sanitary equipment part, which is calculated based on a peak area of a C1s spectrum measured according to Condition 1 by X-ray photoelectron spectroscopy (XPS), is 43 at % or more;

(Condition 1)

X-ray condition: monochromatic AlKα ray (output 25 W)

Photoelectron take-off angle: 45°

Analysis area: 100 μmφ

Scanning range: 15.5 to 1100 eV.

16. A sanitary equipment part comprising:

a base material having a metal element at least on a surface thereof;

a layer of metal oxide formed on the surface of the base material; and a layer of organic compound provided on the layer of metal oxide, wherein the metal element is at least one selected from the group consisting of Cr, Zr, and Ti, the layer of metal oxide contains a metal element which is at least one selected from the group consisting of Cr, Zr, and Ti and an oxygen element, and the layer of organic compound binds to the layer of metal oxide by binding the metal element (M) via an oxygen atom (O) to a phosphorus atom (P) of at least one group (X) selected from a phosphonic acid group, a phosphoric acid group, and a phosphinic acid group (M-O—P bond), and the group X is bonded to a group R, where R is a hydrocarbon group or a group having an atom other than carbon at one or two positions in the hydrocarbon group, and a phosphorus atom concentration on a surface of the sanitary equipment part, which is calculated from a peak area of a P2p spectrum measured according to Condition 1 by X-ray photoelectron spectroscopy (XPS), is 1.0 at % or more and 10 at % or less, and a carbon atom concentration on the surface of the sanitary equipment part, which is calculated based on a peak area of a C1s spectrum measured according to Condition 1 by X-ray photoelectron spectroscopy (XPS), is 43 at % or more;

(Condition 1)

X-ray condition: monochromatic AlKα ray (output 25 W)

Photoelectron take-off angle: 45°

Analysis area: 100 μmφ

Scanning range: 15.5 to 1100 eV.

17. A method of producing the sanitary equipment part according to claim 1, the method comprising:

preparing a base material;

increasing a degree of oxidation of a surface of the base material; and applying a compound represented by a general formula R—X, where R is a hydrocarbon group, and X is at least one selected from a phosphonic acid group, a phosphoric acid group, and a phosphinic acid group.

* * * * *